US011717730B2

(12) United States Patent
Jertson et al.

(10) Patent No.: US 11,717,730 B2
(45) Date of Patent: Aug. 8, 2023

(54) GOLF CLUB HEADS WITH ENERGY STORAGE CHARACTERISTICS

(71) Applicant: KARSTEN MANUFACTURING CORPORATION, Phoenix, AZ (US)

(72) Inventors: Martin R. Jertson, Phoenix, AZ (US); Eric J. Morales, Laveen, AZ (US); Cory S. Bacon, Cave Creek, AZ (US); Calvin Wang, Chandler, AZ (US); Xiaojian Chen, Phoenix, AZ (US); Ryan M. Stokke, Anthem, AZ (US); Travis D. Milleman, Portland, OR (US)

(73) Assignee: Karsten Manufacturing Corporation, Phoenix, AZ (US)

( * ) Notice: Subject to any disclaimer, the term of this patent is extended or adjusted under 35 U.S.C. 154(b) by 0 days.

(21) Appl. No.: 17/341,020

(22) Filed: Jun. 7, 2021

(65) Prior Publication Data

US 2021/0291024 A1 Sep. 23, 2021

Related U.S. Application Data

(63) Continuation of application No. 15/435,054, filed on Feb. 16, 2017, now Pat. No. 11,027,177, which is a (Continued)

(51) Int. Cl.
*A63B 53/04* (2015.01)
*A63B 60/52* (2015.01)

(52) U.S. Cl.
CPC ..... *A63B 53/0466* (2013.01); *A63B 53/04* (2013.01); *A63B 53/0475* (2013.01); (Continued)

(58) Field of Classification Search
CPC . A63B 60/52; A63B 53/0466; A63B 53/0475; A63B 53/0412; A63B 53/04; (Continued)

(56) References Cited

U.S. PATENT DOCUMENTS 4,667,963 A 5/1987 Yoneyama et al.
D319,091 S 8/1991 Antonious
(Continued)

FOREIGN PATENT DOCUMENTS

CN 104740854 7/2015
JP 2001340501 12/2001
(Continued)

OTHER PUBLICATIONS http://www.golfworks.com/product.asp_Q_pn_E_MA0225_A_Maltby+DBM+Forged+Iron+Heads_A_C2p_E_CS, "Maltby Dbm Forged Head", Accessed Oct. 15, 2015. 2.
(Continued)

*Primary Examiner* — William M Pierce

(57) ABSTRACT

Embodiments of golf club heads with energy storage characteristics are presented herein. In some embodiments, a golf club head comprises a hollow body comprising a strikeface, a heel region, a toe region opposite the heel region, a sole, a crown, and a cavity positioned behind the strikeface on at least one of the sole and the crown. In many embodiments, the cavity comprises a front surface, and a rear surface, wherein at least a portion of the front surface extends toward the strikeface of the club head.

16 Claims, 21 Drawing Sheets

Related U.S. Application Data continuation-in-part of application No. 14/920,484, filed on Oct. 22, 2015, now abandoned.

(60) Provisional application No. 62/313,215, filed on Mar. 25, 2016, provisional application No. 62/295,565, filed on Feb. 16, 2016, provisional application No. 62/206,152, filed on Aug. 17, 2015, provisional application No. 62/131,739, filed on Mar. 11, 2015, provisional application No. 62/105,460, filed on Jan. 20, 2015, provisional application No. 62/105,464, filed on Jan. 20, 2015, provisional application No. 62/068,232, filed on Oct. 24, 2014.

(52) U.S. Cl.
CPC ..... *A63B 60/52* (2015.10); *A63B 53/045* (2020.08); *A63B 53/0408* (2020.08); *A63B 53/0412* (2020.08); *A63B 53/0433* (2020.08); *A63B 53/0437* (2020.08); *A63B 2053/0491* (2013.01)

(58) Field of Classification Search
CPC ..... A63B 53/045; A63B 53/0437; A63B 53/0433; A63B 53/0408
See application file for complete search history.

(56) References Cited

U.S. PATENT DOCUMENTS 5,090,702 A 2/1992 Viste et al.
D327,720 S 7/1992 Antonious
5,163,682 A 11/1992 Schmidt
D332,478 S 1/1993 Antonious
5,180,166 A 1/1993 Schmidt
5,184,823 A 2/1993 Desboilles
5,213,328 A 5/1993 Long et al.
5,290,032 A 3/1994 Fenton et al.
5,328,184 A 7/1994 Antonious
5,499,814 A 3/1996 Lu
5,505,453 A 4/1996 Mack
5,564,705 A 10/1996 Kobayashi
5,676,605 A 10/1997 Kobayashi
5,735,754 A * 4/1998 Antonious ..... A63B 53/0466 473/328
5,766,092 A 6/1998 Mimer
6,290,607 B1 9/2001 Gilbert
6,306,048 B1 10/2001 McCabe et al.
6,348,013 B1 2/2002 Kosmatka
6,379,265 B1 4/2002 Hirakawa et al.
6,383,090 B1 5/2002 O'Doherty
6,482,104 B1 11/2002 Gilbert
6,533,679 B1 3/2003 McCabe et al.
6,572,491 B2 6/2003 Hasebe
6,688,989 B2 2/2004 Best
6,695,714 B1 2/2004 Bliss et al.
6,780,123 B2 8/2004 Hasebe
6,811,496 B2 11/2004 Wahl
6,852,038 B2 2/2005 Yabu
6,855,066 B2 2/2005 Best
6,855,069 B2 2/2005 Nagai
6,923,734 B2 8/2005 Meyer
6,971,961 B2 12/2005 Chen
6,984,180 B2 1/2006 Hasebe
6,991,559 B2 1/2006 Yabu
7,029,403 B2 4/2006 Rice
7,125,343 B2 10/2006 Imamoto
7,182,698 B2 2/2007 Tseng
7,232,381 B2 6/2007 Imamoto et al.
7,261,643 B2 8/2007 Rice et al.
D554,217 S 10/2007 Ruggiero
D554,218 S 10/2007 Ruggiero
7,337,861 B2 5/2008 Tateno et al.
7,367,899 B2 5/2008 Rice et al.
7,431,668 B2 10/2008 Tateno
7,435,191 B2 10/2008 Tateno
D581,000 S 11/2008 Nicolette et al.
7,448,964 B2 11/2008 Schweigert et al.
7,455,597 B2 11/2008 Matsunaga
7,470,200 B2 12/2008 Sanchez
7,500,924 B2 3/2009 Yokota
7,503,853 B2 3/2009 Matsunaga
7,513,836 B2 4/2009 Matsunaga
7,549,934 B2 6/2009 Rice
7,588,504 B2 9/2009 Matsunaga
7,591,735 B2 9/2009 Matsunaga
D602,103 S 10/2009 Jorgensen
7,597,633 B2 10/2009 Shimazaki
7,611,423 B2 11/2009 Matsunaga
7,662,051 B2 2/2010 Chen
7,704,162 B2 4/2010 Rice et al.
7,758,440 B2 7/2010 Llewellyn
D621,893 S 8/2010 Nicolette et al.
7,798,915 B2 9/2010 Matsunaga
D635,627 S 4/2011 Nicolette
7,922,604 B2 4/2011 Roach et al.
7,935,001 B2 5/2011 Meyer
D643,492 S 8/2011 Nicolette et al.
8,012,040 B2 9/2011 Takechi
8,043,165 B2 10/2011 Galloway
8,109,842 B2 2/2012 Matsunaga
8,182,365 B2 5/2012 Wada
8,226,501 B2 7/2012 Stites et al.
8,235,841 B2 8/2012 Stites et al.
8,257,195 B1 * 9/2012 Erickson ..... A63B 60/02 473/335
8,277,337 B2 10/2012 Shimazaki
8,403,771 B1 3/2013 Rice
8,449,406 B1 5/2013 Frame et al.
8,647,217 B2 2/2014 Nishio
8,651,975 B2 2/2014 Soracco
8,657,703 B2 2/2014 Wada
8,753,224 B1 6/2014 Kim
8,753,230 B2 6/2014 Stokke et al.
8,758,153 B2 6/2014 Sargent et al.
8,858,360 B2 * 10/2014 Rice ..... A63B 60/54 473/332
8,870,681 B2 10/2014 Yamamoto
8,932,149 B2 1/2015 Oldknow
8,961,336 B1 2/2015 Parsons et al.
8,986,133 B2 3/2015 Bennett et al.
9,011,266 B2 4/2015 Brunski et al.
9,044,653 B2 6/2015 Wahl et al.
9,079,078 B2 7/2015 Greensmith et al.
9,079,080 B2 7/2015 Jertson
9,089,747 B2 7/2015 Boyd et al.
9,089,749 B2 7/2015 Burnett et al.
9,162,115 B1 10/2015 Beach et al.
9,168,435 B1 10/2015 Boggs et al.
9,192,830 B2 11/2015 Parsons et al.
9,265,995 B2 2/2016 Roberts et al.
9,415,280 B2 8/2016 Stokke et al.
9,492,722 B2 11/2016 Taylor
9,517,393 B2 12/2016 Cardani et al.
9,610,481 B2 4/2017 Parsons
9,636,552 B2 5/2017 Cleghorn
9,682,293 B2 6/2017 Bennett
9,764,208 B1 9/2017 Parsons
9,802,091 B2 10/2017 Taylor
9,814,952 B2 11/2017 Parsons
9,844,710 B2 12/2017 Parsons
9,901,792 B2 2/2018 Franklin
9,908,018 B2 3/2018 Roberts et al.
9,914,030 B2 3/2018 Cleghorn
9,937,390 B2 4/2018 Luttrell
9,937,395 B2 4/2018 Taylor
9,937,396 B2 4/2018 Stites et al.
9,950,219 B2 4/2018 Larson
9,993,704 B2 6/2018 Hebreo et al.
10,029,158 B2 8/2018 Parsons
10,046,211 B2 8/2018 Franklin
10,099,103 B2 10/2018 Golden
10,124,224 B2 11/2018 Solheim et al.

(56) References Cited

U.S. PATENT DOCUMENTS

| | | | | |
|---|---|---|---|---|
| 10,150,019 | B2 | 12/2018 | Ines et al. | |
| 10,220,272 | B2 | 3/2019 | Gonzalez et al. | |
| 10,245,474 | B2 * | 4/2019 | Boggs | A63B 53/0466 |
| 10,357,695 | B2 | 7/2019 | Boggs et al. | |
| 10,543,405 | B2 | 1/2020 | Greaney et al. | |
| 10,646,754 | B2 | 5/2020 | Boggs et al. | |
| 2003/0176232 | A1 | 3/2003 | Hasebe | |
| 2004/0087388 | A1 | 5/2004 | Beach | |
| 2004/0185960 | A1 | 9/2004 | Chen | |
| 2005/0009626 | A1 | 1/2005 | Imamoto et al. | |
| 2005/0021913 | A1 | 1/2005 | Heller, Jr. | |
| 2007/0026961 | A1 * | 2/2007 | Hou | A63B 53/047 473/329 |
| 2007/0049405 | A1 | 3/2007 | Tateno | |
| 2009/0325729 | A1 | 12/2009 | Takechi | |
| 2010/0130302 | A1 | 5/2010 | Galloway | |
| 2011/0021285 | A1 | 1/2011 | Shimazaki | |
| 2011/0111883 | A1 | 5/2011 | Cackett | |
| 2011/0183776 | A1 | 7/2011 | Breier et al. | |
| 2012/0135821 | A1 | 5/2012 | Boyd et al. | |
| 2012/0149494 | A1 | 6/2012 | Takahashi | |
| 2013/0109500 | A1 | 5/2013 | Boyd et al. | |
| 2013/0116065 | A1 | 5/2013 | Yamamoto | |
| 2013/0165252 | A1 | 6/2013 | Rice | |
| 2013/0165254 | A1 | 6/2013 | Rice | |
| 2013/0225319 | A1 | 8/2013 | Kato | |
| 2013/0281229 | A1 | 10/2013 | Su | |
| 2013/0316848 | A1 | 11/2013 | Burnett et al. | |
| 2013/0324295 | A1 | 12/2013 | Oldknow | |
| 2013/0331201 | A1 | 12/2013 | Wahl et al. | |
| 2014/0080627 | A1 | 3/2014 | Bennett et al. | |
| 2014/0080634 | A1 | 3/2014 | Golden | |
| 2014/0329615 | A1 | 11/2014 | Roberts et al. | |
| 2014/0364248 | A1 | 12/2014 | Roberts et al. | |
| 2015/0031472 | A1 | 1/2015 | Stokke et al. | |
| 2015/0165285 | A1 | 6/2015 | Stites et al. | |
| 2015/0217167 | A1 | 8/2015 | Frame | |
| 2015/0231806 | A1 | 8/2015 | Parsons | |
| 2015/0352415 | A1 * | 12/2015 | Bennett | A63B 60/54 473/329 |
| 2016/0114229 | A1 | 4/2016 | Jertson et al. | |

FOREIGN PATENT DOCUMENTS

| | | |
|---|---|---|
| JP | 2002143356 | 5/2002 |
| JP | 2003062132 | 3/2003 |
| JP | 2006212066 | 8/2006 |
| JP | 2008054985 | 3/2008 |
| JP | 2010167131 | 8/2010 |
| JP | 5315577 | 10/2013 |
| JP | 2014008287 | 1/2014 |
| JP | 2014180540 | 9/2014 |
| JP | 5763701 | 8/2015 |

OTHER PUBLICATIONS http://www.golfalot.com/equipment-news/taylormade-sldr-irons-2857.aspx, "Taylor Made Sldr Irons", Published May 5, 2014, Accessed Oct. 15, 2015.

http://www.golfwrx.com/322138/you-can-see-inside-cobras-king-ltd-drivers-andfairway-woods/, "You can see inside Cobra's King Ltd drivers and fairway woods". Zak Kozuchowski, Accessed on Oct. 15, 2015.

International Search Report and Written Opinion of Corresponding U.S. Appl. No. 14/920,484, entitled "Golf Club Heads With Energy Storage Characteristics," filed Oct. 22, 2015.

* cited by examiner

1000

GOLF CLUB HEADS WITH ENERGY STORAGE CHARACTERISTICS

CROSS-REFERENCE TO RELATED APPLICATIONS

This is a continuation of U.S. patent application Ser. No. 15/435,054 filed Feb. 16, 2017, which is a continuation in part of U.S. patent application Ser. No. 14/920,484, filed on Oct. 22, 2015, which claims the benefit of U.S. Provisional Application No. 62/206,152, filed Aug. 17, 2015, U.S. Provisional Application No. 62/131,739, filed Mar. 11, 2015, U.S. Provisional Application No. 62/105,460, filed Jan. 20, 2015, U.S. Provisional Application No. 62/105,464, filed Jan. 20, 2015, and U.S. Provisional Application No. 62/068,232, filed Oct. 24, 2014. U.S. patent application Ser. No. 15/435,054 also claims the benefit of U.S. Provisional Patent Application No. 62/295,565, filed on Feb. 16, 2016, and U.S. Provisional Patent Application No. 62/313,215, filed on Mar. 25, 2016. The contents of all of the above described disclosures are fully incorporated by reference herein in their entirety.

TECHNICAL FIELD

This disclosure relates generally to golf clubs, and relates more particularly to golf club heads with energy storage characteristics.

BACKGROUND

Golf club manufacturers have designed golf club heads to relieve stress in the strikeface of the golf club head. In many instances, these designs do not allow the golf club head to flex in the crown to sole direction. Additionally, these designs may not change where peak bending of the golf club head occurs and do not allow additional storage of spring energy in the golf club head due to impact with the golf ball. Additional spring energy can increase ball speed across the strikeface.

BRIEF DESCRIPTION OF THE DRAWINGS

To facilitate further description of the embodiments, the following drawings are provided in which.

Figure 1:
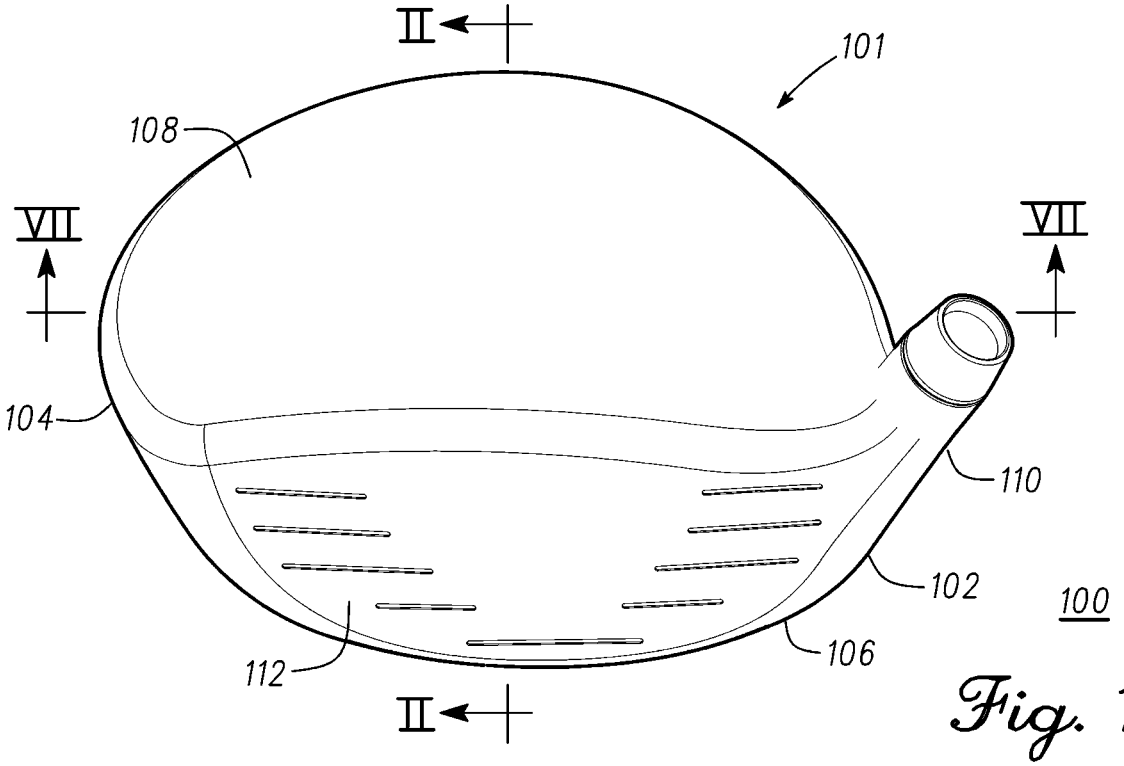
FIG. 1 depicts a front, crown-side perspective view of a golf club head according to an embodiment.

For simplicity and clarity of illustration, the drawing figures illustrate the general manner of construction, and descriptions and details of well-known features and techniques may be omitted to avoid unnecessarily obscuring the golf clubs and their methods of manufacture. Additionally, elements in the drawing figures are not necessarily drawn to scale. For example, the dimensions of some of the elements in the figures may be exaggerated relative to other elements to help improve understanding of embodiments of the golf clubs and their methods of manufacture. The same reference numerals in different figures denote the same elements.

The terms "first," "second," "third," "fourth," and the like in the description and in the claims, if any, are used for distinguishing between similar elements and not necessarily for describing a particular sequential or chronological order. It is to be understood that the terms so used are interchangeable under appropriate circumstances such that the embodiments of golf clubs and methods of manufacture described herein are, for example, capable of operation in sequences other than those illustrated or otherwise described herein. Furthermore, the terms "contain," "include," and "have," and any variations thereof, are intended to cover a non-exclusive inclusion, such that a process, method, article, or apparatus that comprises a list of elements is not necessarily limited to those elements, but may include other elements not expressly listed or inherent to such process, method, article, or apparatus.

The terms "left," "right," "front," "back," "top," "bottom," "side," "under," "over," and the like in the description and in the claims, if any, are used for descriptive purposes and not necessarily for describing permanent relative positions. It is to be understood that the terms so used are interchangeable under appropriate circumstances such that the embodiments of golf clubs and methods of manufacture described herein are, for example, capable of operation in other orientations than those illustrated or otherwise described herein. The term "coupled," as used herein, is defined as directly or indirectly connected in a physical, mechanical, or other manner.

DESCRIPTION OF EXAMPLES OF EMBODIMENTS

Various embodiments of the golf club heads with tiered internal thin sections include a golf club head comprising a body. The body comprises a strikeface, a heel region, a toe region opposite the heel region, a sole, a crown, and an internal radius transition region from the strikeface to at least one of the sole or the crown. In many embodiments, the internal radius transition region is not visible from an exterior of the golf club head and comprises a first tier, a second tier, and a tier transition region between the first tier and the second tier.

Another embodiment of the golf club heads with tiered internal thin sections include a golf club comprising a golf club head and a shaft coupled to the golf club head. The golf club head comprises a strikeface, a heel region, a toe region opposite the heel region, a sole, a crown, and an internal radius transition region from the strikeface to at least one of the sole or the crown. In many embodiments, the internal radius transition region is not visible from an exterior of the golf club head and comprises a first tier, a second tier, and a tier transition region between the first tier and the second tier.

Other embodiments of the golf club heads with tiered internal thin sections include a method for manufacturing a golf club head. The method comprises providing a body. The body comprises a strikeface, a heel region, a toe region opposite the heel region, a sole, and a crown. The method further comprises providing an internal radius transition region from the strikeface to at least one of the sole or the crown. The internal radius transition region is not visible from an exterior of the golf club head and comprises a first tier, a second tier, and a tier transition region between the first tier and the second tier. In many embodiments, the first tier has a first thickness, the second tier has a second thickness, and the second thickness is smaller than the first thickness.

Various embodiments include a golf club head comprising a hollow body. The hollow body comprises a strikeface, a heel region, a toe region opposite the heel region, a sole, and a crown. In many embodiments, the crown comprises an upper region comprising a top rail, and a lower region. In some embodiments, a cavity is located below the top rail, is located above the lower region of the crown, and is defined at least in part by the upper and lower regions of the crown. In many embodiments, the cavity comprises a top wall, a back wall, a bottom incline, a back cavity angle measured between the top and back walls of the cavity, and at least one channel.

Some embodiments include a golf club comprising a hollow-bodied golf club and a shaft coupled to the hollow-bodied golf club head. The hollow-bodied golf club head comprises a strikeface, a heel region, a toe region opposite the heel region, a sole, and a crown. In many embodiments, the crown comprises an upper region comprising a top rail, and a lower region. In some embodiments, a cavity is located below the top rail, is located above the lower region of the crown, and is defined at least in part by the upper and lower regions of the crown. In many embodiments, the cavity comprises a top wall, a back wall, a bottom incline, a back cavity angle measured between the top and back walls of the cavity, and at least one channel.

Other embodiments include a method for manufacturing a golf club head. In many embodiments, the method comprises providing a body. The body having a strikeface, a heel region, a toe region opposite the heel region, a sole, and a crown. The crown comprises an upper region comprising a top rail and a lower region. In some embodiments, a cavity is located below the top rail, above the lower region of the crown, and is defined at least in part by the upper and lower regions of the crown. In many embodiments, the cavity comprises a top wall, a back wall adjacent to the top wall, a bottom incline adjacent to the back wall, a back cavity angle measured between the top and back walls of the cavity, and at least one channel.

Other examples and embodiments are further disclosed herein. Such examples and embodiments may be found in the figures, in the claims, and/or in the present description.

I. Golf Club Head with Cascading Sole

Turning to the drawings, FIG. 1 illustrates an embodiment of a golf club head 100. Golf club head 100 can be a wood-type golf club head. For example, golf club head 100 can be a fairway wood-type golf club head or a driver-type golf club head or a hybrid-type golf club head or an iron-type golf club head. Golf club head 100 comprises a body 101. Body 101 comprises a strikeface 112, a heel region 102, a toe region 104, a sole 106, and a crown 108.

Figure 18:
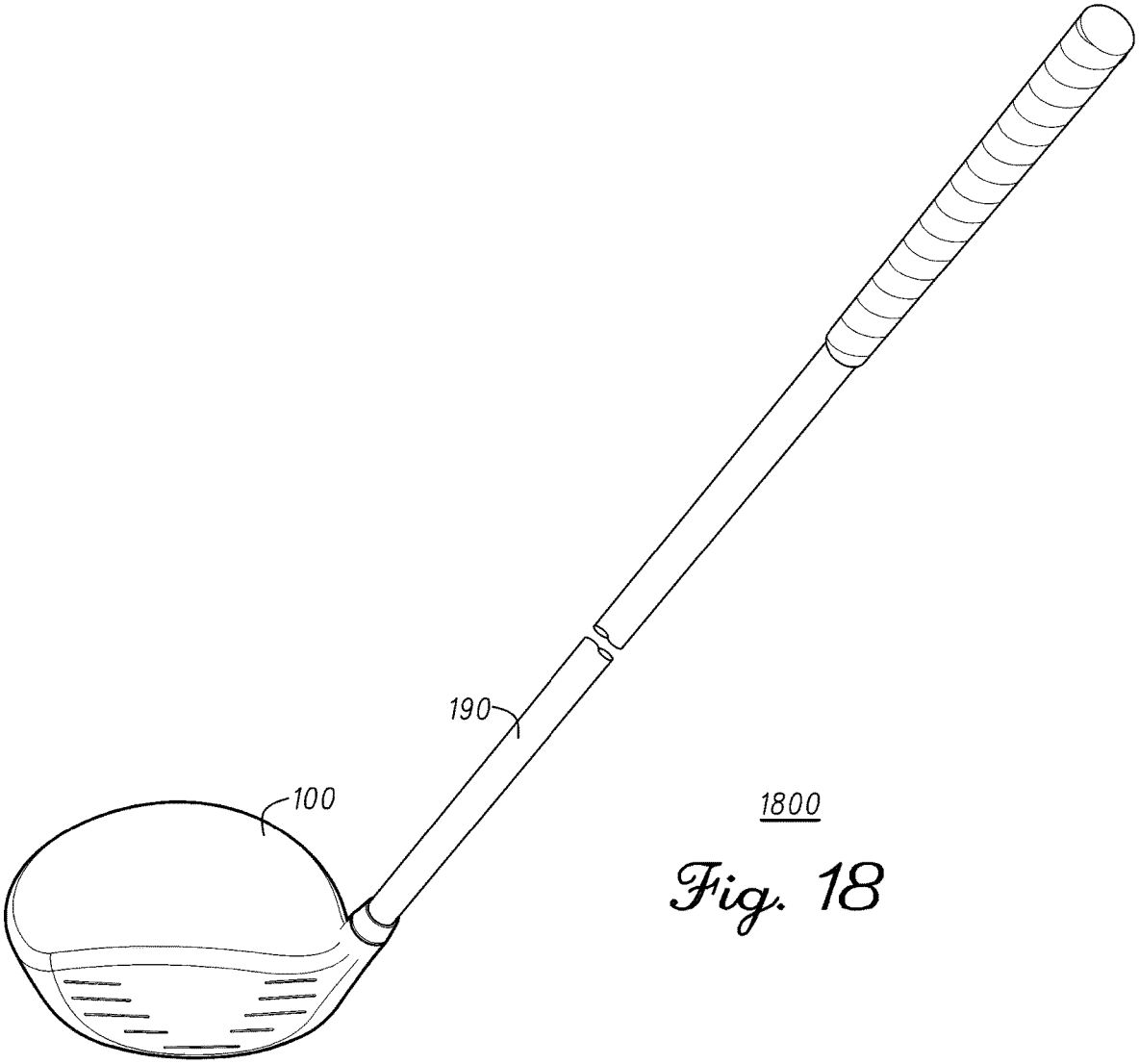
FIG. 18 depicts a front perspective view of a golf club according to another embodiment.

In FIG. 1, body 101 also comprises a skirt 110 extending between sole 106 and crown 108. In some embodiments, body 101 does not comprise skirt 110 or any skirt. FIG. 18 depicts a front perspective view of a golf club 1800 according to an embodiment. In some embodiments, golf club 1800 comprises golf club head 100 and a shaft 190.

In some embodiments, body 101 can comprise stainless steel, titanium, aluminum, a steel alloy (e.g. 455 steel, 475 steel, 431 steel, 17-4 stainless steel, maraging steel), a titanium alloy (e.g. Ti 7-4, Ti 6-4, T-9S), an aluminum alloy, or a composite material. In some embodiments, strikeface 112 can comprise stainless steel, titanium, aluminum, a steel alloy (e.g. 455 steel, 475 steel, 431 steel, 17-4 stainless steel, maraging steel), a titanium alloy (e.g. Ti 7-4, Ti 6-4, T-9S), an aluminum alloy, or a composite material. In some embodiments, body 101 can comprise the same material as strikeface 112. In some embodiments, body 101 can comprise a different material than strikeface 112.

Figure 2:
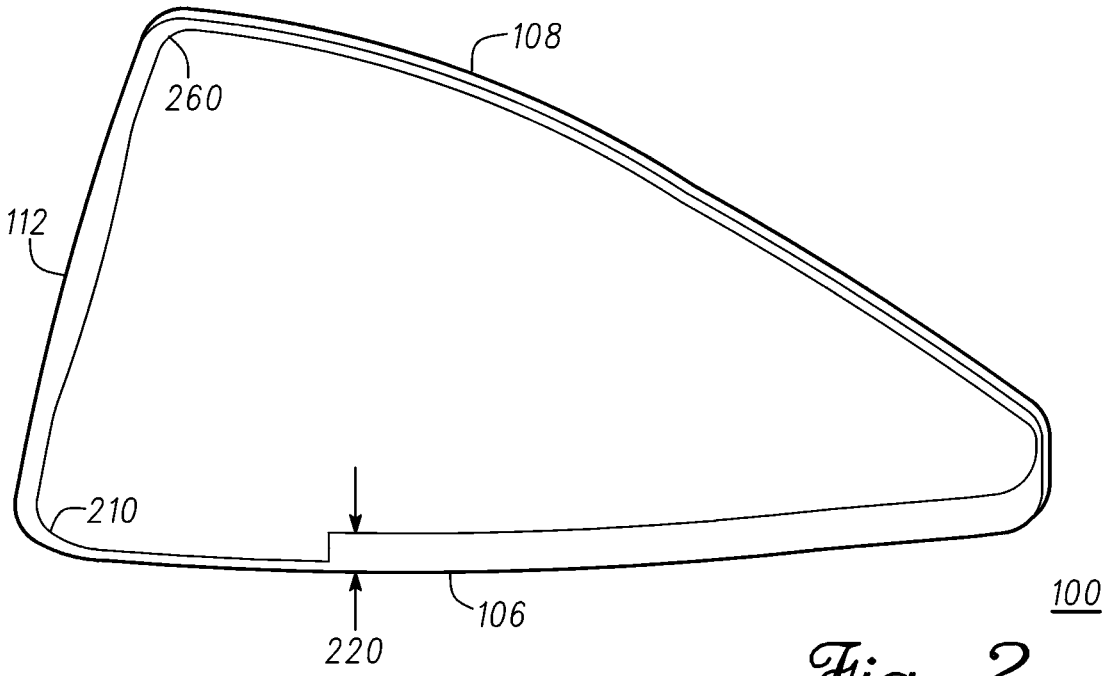
FIG. 2 depicts the golf club head of FIG. 1 along the cross-sectional line II-II in FIG. 1.

FIG. 2 illustrates a cross-section of golf club head 100 along the cross-sectional line II-II in FIG. 1, according to one embodiment. FIG. 2 shows an internal radius transition 210 from strikeface 112 to sole 106, according to an embodiment. Internal radius transition 210 can comprise a smooth transition, or internal radius transition 210 can comprise a cascading sole of at least two tiers or levels of thickness. For example, internal radius transition 210 can comprise a cascading sole having 2, 3, 4, 5, 6, or 7 tiers. In some embodiments, internal radius transition can provide more bending of strikeface 112. In some examples, the increase in bending or deflection of strikeface 112 can allow approximately 1% to approximately 3% more energy from the deflection of strikeface 112.

In many embodiments, internal radius transition 210 is not visible from an exterior of golf club head 100. FIG. 2 also shows a top internal radius transition 260 from strikeface 112 to crown 108. In some embodiments, top internal radius transition 260 can comprise a smooth transition, while in other embodiments, top internal radius transition 260 can comprise at least two tiers or levels of thickness. For example, top internal radius transition 260 can comprise 2, 3, 4, 5, 6, or 7 tiers or levels of thickness. In some embodiments, golf club head 100 also can have an internal sole thickness 220. Internal sole thickness 220 can be thicker than the smallest thickness of internal radius transition 210. In many embodiments, internal sole thickness 220 also is thicker than an adjacent tier or a final tier in internal radius transition 210. In some embodiments, internal sole thickness 220 can be thicker than all of internal radius transition 210.

In some embodiments, internal radius transition 210 can be similar to the sole front section and/or the weight distribution channels as described in U.S. Pat. No. 8,579,728, entitled Golf Club Heads with Weight Redistribution Channels and Related Methods, which is incorporated by reference herein.

In some embodiments, the golf club head can comprise a cascading transition region, tiered transition region or internal radius transition from the strikeface to at least one of a crown, a heel, a toe, a sole, or a skirt. In some embodiments, the golf club head can comprise a single, continuous tiered transition region ring around a circumference of perimeter of the golf club head, for example a tiered transition region ring from the strikeface to each of the crown, the toe region, the heel region, and the sole region. In other embodiments, the golf club head comprises a tiered transition region only at the crown and/or at the sole. In some embodiments, the golf club head comprises a tiered transition region only at the toe region and/or at the heel region. In other examples, the tiered transition region is only located from the strikeface to the skirt. In other embodiments, the golf club head comprises separate or individual tiered transition regions from the strikeface to the toe region of the crown, the heel region of the crown, the toe region of the sole, and/or the heel region of the sole.

Figure 3:
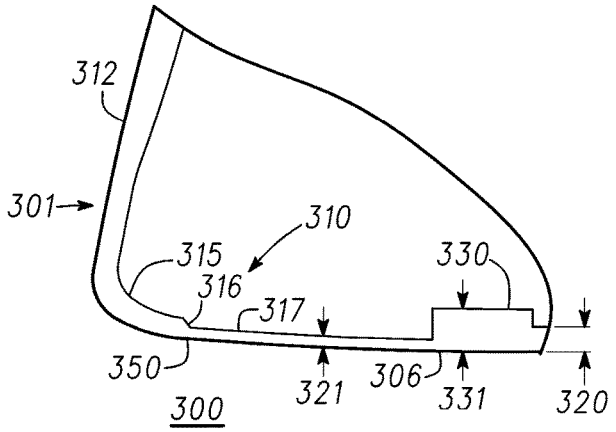
FIG. 3 depicts a view of a portion of a golf club head that is similar to the golf club head of FIG. 1, along a cross-sectional line similar to the cross-sectional line II-II in FIG. 1, according to another embodiment.
Figure 4:
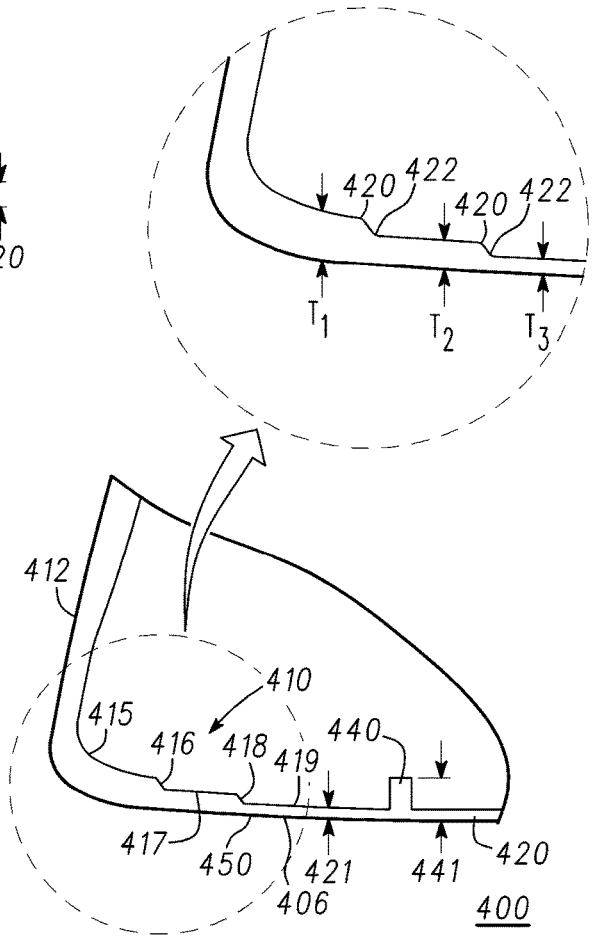
FIG. 4 depicts a view of a portion of a golf club head that is similar to the golf club head of FIG. 1, along a cross-sectional line similar to the cross-sectional line II-II in FIG. 1, according to another embodiment.
Figure 5:
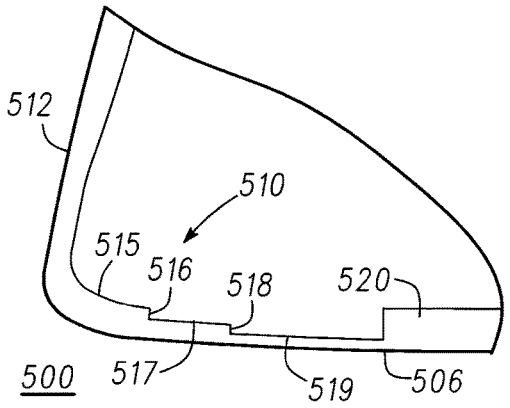
FIG. 5 depicts a view of a portion of a golf club head that is similar to the golf club head of FIG. 1, along a cross-sectional line similar to the cross-sectional line II-II in FIG. 1, according to another embodiment.

FIG. 3 depicts a view of an internal radius transition 310 of a golf club head 300 that is similar to the golf club head of FIG. 1, along a cross-sectional line similar to the cross-sectional line II-II in FIG. 1, according to another embodiment. FIG. 4 depicts a view of an internal radius transition 410 of a golf club head 400 that is similar to the golf club head of FIG. 1, along a cross-sectional line similar to the cross-sectional line II-II in FIG. 1, according to another embodiment. FIG. 5 depicts a view of an internal radius transition 510 of a golf club head 500 that is similar to the golf club head of FIG. 1, along a cross-sectional line similar to the cross-sectional line II-II in FIG. 1, according to another embodiment.

As shown in FIG. 3, internal radius transition 310 can be can be similar to internal radius transition 210 (FIG. 2) and golf club head 300 can be similar to golf club head 100 (FIGS. 1 and 2). Internal radius transition 310 comprises a first tier 315 having a first thickness, and a second tier 317 having a second thickness. In many embodiments, the thickness of each tier is substantially constant. For example, the first thickness of first tier 315 can comprise a first substantially constant thickness, and the second thickness of second tier 317 can comprise a second substantially constant thickness. In other embodiments, first tier 315 can comprise a first slope, wherein the first thickness of first tier 315 is thicker closer to strikeface 312 and thinner closer to a tier transition region 316. Tier transition region 316 can comprise a tier slope that is steeper than the first slope of first tier 315. Tier transition region 316 can be linearly sloped at an angle less than 90 degrees to transition from first tier 315 to second tier 317. In other embodiments, tier transition region 316 can comprise an approximately 90 degree step, as shown in tier transition regions 516 and 518 of FIG. 5. Tier transition region 516 (FIG. 5) and 518 (FIG. 5) can be similar to tier transition region 316 (FIG. 3), and tier transition regions 416 (FIG. 4) and 418 (FIG. 4).

As shown in FIG. 4, in some embodiments, each tiered transition 316, 416, 418, 516, 518 can include a first arcuate surface 420 and a second arcuate surface 422. The first arcuate surface 420 has a first radius of curvature and the second arcuate surface 422 has a second radius of curvature. The first radius of curvature and the second radius of curvature of each tiered transition 316, 416, 418, 516, 518 can be the same, or the first radius of curvature and the second radius of curvature of each tiered transition 316, 416, 418, 516, 518 can be different. For example, the first radius of curvature of the first arcuate surface 420 can be the same as the second radius of curvature of the first arcuate surface 420, the first radius of curvature of the first arcuate surface 420 can be less than the second radius of curvature of the first arcuate surface 420, or the first radius of curvature of the first arcuate surface 420 can be greater than the second radius of curvature of the first arcuate surface 420. For further example, the first radius of curvature of the second arcuate surface 422 can be the same as the second radius of curvature of the second arcuate surface 422, the first radius of curvature of the second arcuate surface 422 can be less than the second radius of curvature of the second arcuate surface 422, or the first radius of curvature of the second arcuate surface 422 can be greater than the second radius of curvature of the second arcuate surface 422.

Further, each of the tiered transitions 316, 416, 418, 516, 518 can have the same first radius of curvature or a different first radius of curvature, and each of the tiered transitions 316, 416, 418, 516, 518 can have the same second radius of curvature or a different second radius of curvature. For example, the first radius of curvature of the first arcuate surface 420 can be the same as the first radius of curvature of the second arcuate surface 422, the first radius of curvature of the first arcuate surface 420 can be less than the first radius of curvature of the second arcuate surface 422, or the first radius of curvature of the first arcuate surface 420 can be greater than the first radius of curvature of the second arcuate surface 422. For further example, the second radius of curvature of the first arcuate surface 420 can be the same as the second radius of curvature of the second arcuate surface 422, the second radius of curvature of the first arcuate surface 420 can be less than the second radius of curvature of the second arcuate surface 422, or the second radius of curvature of the first arcuate surface 420 can be greater than the second radius of curvature of the second arcuate surface 422.

The internal radius transition features (e.g. internal tier transition 310, FIG. 3) can change where a peak bending of a golf club head occurs. The tiered transition region can create a "plastic hinge" at the peak bending, promoting more localized deformation due to impact with the golf ball. In many embodiments, the buckling process starts at the location of the peak bending and the golf club head is optimized to stay just under the critical buckling threshold. The intentional plastic hinge allows the club to flex more in the crown and sole direction. Intentional Plastic Hinge allows control over exactly where and how much the crown and sole will flex by using the tiered features.

Using the internal radius transition, the stress of the golf club head can be distributed across a larger volume of material, thus lowering the localized peak stress. In many embodiments, the additional flex from crown to sole allows the face to bend further based on the same loading. This additional flex can generate more stress and bending in the face of the club to create more spring energy. An increase in spring energy can be stored in the golf club head due to an impact with the golf ball. In many embodiments, the additional spring energy will help to increase ball speed. In some embodiments, the internal radius transition can create more overall bending in the golf club head, which also can lead to more ball speed. Higher ball speeds across the strikeface can result in better distance control. In some embodiments, the golf club head with internal radius transition features can store approximately 4% to approximately 6% more energy, which can then be returned to the golf ball.

Returning to FIG. 3, internal radius transition 310 can change where a peak bending 350 of the sole of golf club head 300 occurs. In addition, internal radius transition 310 can engage more of the body of club head 300 in the bending process on impact from a golf ball. In some embodiments, first tier 315 and second tier 317 allow some of the stress created by an impact of strikeface 312 with the golf ball to build up on each tier. This structure can prevent the stress from collecting primarily at the thinnest section of the sole to increase the reliability and durability of golf club head 300. In many embodiments, this structure creates a plastic hinge opposite the strikeface end of internal radius transition 310 and promotes more localized deformation at the plastic hinge location. In many embodiments, the plastic hinge can be located at the peak bending, for example, peak bending 350. This structure also can allow for the storage of more potential energy, for example, in the crown and/or the sole. In some embodiments, body 301 can experience an increase of approximately 4% to approximately 7% in flex or bending in the crown to sole direction at the sole and/or the crown. The additional flex in the crown to sole direction at the sole and/or the crown can allow strikeface 312 to bend further on the same loading or impact by the golf ball. Therefore, this structure can create more stress and bending in strikeface 312 of golf club head 300 that can be transferred to the ball on impact with the strikeface 312.

In some embodiments, each tier comprises an approximately constant thickness throughout the tier. In many embodiments, first tier 315 is thicker than second tier 317. In some embodiments of a driver-type golf club head, first tier 315 can be approximately 0.030 inch (0.076 cm) to approximately 0.060 inch (0.152 cm) thick, or approximately 0.040 inch (0.102 cm) to approximately 0.050 inch (0.127 cm) thick, and second tier 317 can be approximately 0.020 inch (0.051 cm) to approximately 0.050 inch thick (0.127 cm), or approximately 0.030 inch (0.076 cm) to approximately 0.040 inch (0.102 cm) thick. In some embodiments of a fairway wood-type golf club head, first tier 315 can be approximately 0.035 inch (0.089 cm) to approximately 0.065 inch (0.165 cm) thick, or approximately 0.045 inch (0.114 cm) to approximately 0.055 inch (0.140 cm) thick, and second tier 317 can be approximately 0.025 inch (0.064 cm) to approximately 0.055 inch (0.140 cm) thick, or approximately 0.035 inch (0.089 cm) to approximately 0.045 inch (0.114 cm) thick. In some embodiments of a hybrid-type golf club head, first tier 315 can be approximately 0.050 inch (0.127 cm) to approximately 0.080 inch (0.203 cm) thick, or approximately 0.060 inch (0.152 cm) to approximately 0.070 inch thick (0.178 cm), and second tier 317 can be approximately 0.040 inch (0.102 cm) to approximately 0.070 inch (0.178 cm) thick, or approximately 0.050 inch (0.127 cm) to approximately 0.060 inch (0.152 cm) thick. In many embodiments of an iron-type golf club head, the first tier 315 can be approximately 0.055 inch (0.140 cm) to approximately 0.085 inch (0.216 cm) thick, or approximately 0.060 inch (0.152 cm) to approximately 0.080 inch thick (0.203 cm), and the second tier 317 can be approximately 0.045 inch (0.114 cm) to approximately 0.075 inch (0.191 cm) thick, or approximately 0.050 inch (0.127 cm) to approximately 0.070 inch (0.178 cm) thick.

In other embodiments, such as shown in FIG. 4, internal radius transition 410 can have more than 2 tiers. For example, internal radius transition 410 can have 2, 3, 4, 5, 6, or 7 tiers. A three tier internal radius transition 410 can be similar to internal radius transition 310 (FIG. 3) and has a first tier 415, a second tier 417, and a third tier 419. First tier 415 can be similar to first tier 315 in FIG. 3, and second tier 417 can be similar to second tier 317. In many embodiments, a peak bending 450 can occur further back from strikeface 412 as more tiers are added to the internal radius transition.

In many embodiments, second tier 417 is thicker than third tier 419. In some embodiments of a driver-type golf club head, third tier 419 is approximately 0.010 inch to approximately 0.040 inch (0.102 cm) thick, or approximately 0.020 inch (0.051 cm) to approximately 0.030 inch (0.076 cm) thick. In some embodiments of a fairway wood-type golf club head, third tier 419 is approximately 0.015 inch (0.038 cm) to approximately 0.045 inch (0.114 cm) thick, or approximately 0.025 inch (0.064 cm) to approximately 0.035 inch (0.089 cm) thick. In some embodiments of a hybrid-type golf club head, third tier 419 is approximately 0.030 inch (0.076 cm) to approximately 0.060 inch (0.152 cm) thick, or approximately 0.040 inch (0.102 cm) to approximately 0.050 inch (0.127 cm) thick. In some embodiments of an iron-type club head the third tier 419 is approximately 0.030 inch (0.076 cm) to approximately 0.060 inch (0.152 cm) thick, or approximately 0.035 inch (0.089 cm) to approximately 0.055 inch (0.140 cm) thick.

Meanwhile, referring to FIG. 5, in some embodiments of a driver-type golf club head, first tier 515 can be approximately 0.045 inch (0.114 cm) thick; second tier 517 can be approximately 0.035 inch (0.089 cm) thick; and third tier 519 can be approximately 0.025 inch (0.064 cm) thick. In some embodiments of a fairway wood-type golf club head, first tier 515 can be approximately 0.051 inch (0.130 cm) thick; second tier 517 can be approximately 0.039 inch (0.099 cm) thick; and third tier 519 can be approximately 0.030 inch (0.076 cm) thick. In some embodiments of a hybrid-type golf club head, first tier 515 can be approximately 0.067 inch (0.170 cm) thick; second tier 517 can be approximately 0.054 inch (0.137 cm) thick; and third tier 519 can be approximately 0.045 inch (0.114 cm) thick. In some embodiments of an iron-type club head, the first tier 515 can be approximately 0.067 inch (0.170 cm) thick; the second tier can be approximately 0.057 inch (0.145 cm) thick; and the third tier 519 can be approximately 0.042 inch (0.107 cm) thick.

In some embodiments, first tiers 315, 415, 515 in FIGS. 3, 4, and 5, respectively, can have a first tier length that is approximately equal to a second tier length of second tiers 317, 417, 517 in FIGS. 3, 4, and 5, respectively. In some embodiments, the first tier length of first tiers 315, 415, 515 in FIGS. 3, 4, and 5, respectively, can have a first tier length that is longer than the second tier length of second tiers 317, 417, 517. In other embodiments, the second tier length of second tiers 417, 517 in FIGS. 4 and 5, respectively, can be approximately equal to a third tier length of third tiers 419, 519 in FIGS. 4 and 5, respectively. In some embodiments, the second tier length of second tiers 417, 517 in FIGS. 4 and 5, respectively, can be longer than the third tier length of third tiers 419, 519 in FIGS. 4 and 5, respectively. In other embodiments, the second tier length of second tiers 417, 517 in FIGS. 4 and 5, respectively, can be shorter than the third tier length of third tiers 419, 519 in FIGS. 4 and 5, respectively.

Referring to FIGS. 3, 4, and 5, in some embodiments of a fairway wood-type golf club head or a driver-type golf club head or a hybrid-type golf club head, the first tiers 315, 415, 515 can have first tier lengths of approximately 0.05 inch (0.127 cm) to approximately 0.80 inch (2.03 cm); the second tiers 317, 417, 517 can have second tier lengths of approximately 0.03 inch (0.076 cm) to approximately 0.60 inch (1.52 cm); and the third tiers 419, 519 can have third tier lengths of approximately 0.04 inch (0.102 cm) to approximately 0.70 inch (1.78 cm). In some embodiments of an iron-type golf club head, the first tiers 315, 415, 515 can have first tier lengths of approximately 0.03 inch (0.076 cm) to approximately 0.30 inch (0.762 cm); the second tiers 317, 417, 517 can have second tier lengths of approximately 0.04 inch (0.102 cm) to approximately 0.40 inch (1.02 cm); and the third tiers 419, 519 can have third tier lengths of approximately 0.05 inch (0.127 cm) to approximately 0.50 inch (1.27 cm).

As shown in FIGS. 3, 4, and 5, in some embodiments, the first and the second arcuate surface of tiered transitions 316, 416, 516 can have first and second radii of curvatures that are at least two times larger than the difference between the first thickness $T_1$ and the second thickness $T_2$ of the first tier 315, 415, 515, and the second tier 317, 417, 517, respectively. In one embodiment, the first and the second arcuate surface of tiered transitions 316, 416, 516 has a first and a second radius of curvature that are approximately 6.5 times larger than the difference between the first thicknesses $T_1$ and the second thickness $T_2$ of the first tier 315, 415, 515 and the second tier 317, 417, 517, respectively. As shown in FIGS. 4 and 5, in some embodiments, the first and the second arcuate surface of tiered transitions 418, 518 can have first and second radii of curvatures that are at least two times larger than the difference between the second thickness $T_2$ and the third thickness $T_3$ of the second tier 417, 517 and the third tier 419, 519, respectively. In one embodiment, the first and the second arcuate surface of tiered transitions 418, 518 has a first and a second radius of curvature that are approximately 6.5 times larger than the difference between the second thicknesses $T_2$ and the third thickness $T_3$ of the second tier 417, 517 and the third tier 419, 519, respectively.

Some embodiments, such as golf club head 300, as shown in FIG. 3, comprise weight pad 330 to lower the center of gravity of golf club head 300. Weight pad 330 comprises a weight pad thickness 331 that is greater than the final tier thickness 321 of the adjacent tier. In this example, the adjacent tier is second tier 317. In many embodiments which comprise weight pad 330, internal sole thickness 320 can be approximately equal to final tier thickness 321. In some embodiments, internal sole thickness 320 can be thicker than final tier thickness 321. In some embodiments, internal sole thickness 320 is thinner than final tier thickness 321.

Some embodiments, such as golf club head 400, as shown in FIG. 4, comprise a rib 440. Rib 440 can be located internal to body 401 and approximately parallel to the strikeface. In many embodiments, rib 440 can be a ridge or bar. In some embodiments, rib 440 can have a rib thickness 441 that is greater than a third tier thickness 421, the thickness of the adjacent tier, or the thickness of the final tier of internal radius transition 410. The purpose for rib 440 is to reinforce the sole of golf club head 400 so that the peak bending of the sole occurs at tier transition region 416 and/or tier transition region 418.

Figure 6:
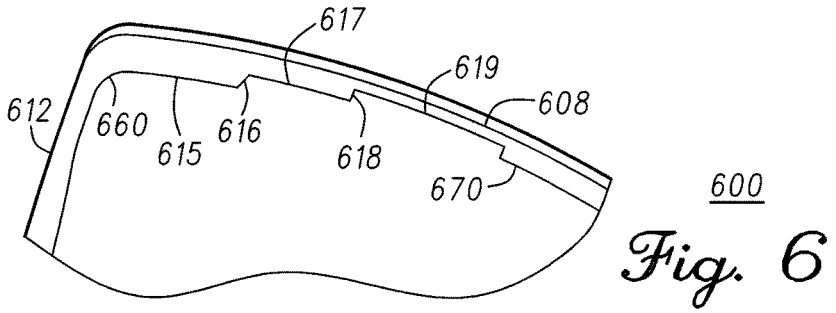
FIG. 6 depicts a view of another portion of a golf club head that is similar to the golf club head of FIG. 1, along a cross-sectional line similar to the cross-sectional line II-II in FIG. 1, according to another embodiment.

Turning to FIG. 6, in some embodiments, golf club head 600 can comprise a crown internal radius transition 660 at crown 608. Crown internal radius transition 660 can be similar to internal radius transition 310 in FIG. 3, except crown internal radius transition 660 is located at the strikeface to crown transition instead of the strikeface to sole transition. In many embodiments, first tier 615 can be similar to first tiers 315, 415, and/or 515 in FIGS. 3, 4, and 5, respectively; second tier 617 can be similar to second tiers 317, 417, and/or 517 in FIGS. 3, 4, and 5, respectively; third tier 619 can be similar to third tiers 419 and/or 519 in FIGS. 4 and 5, respectively; and tier transition regions 616 and/or 618 can be similar to tier transition regions 316, 416, 516, 418, and/or 518 in FIGS. 3, 4, and 5. Similarly, the crown internal radius transition 660 can have several internal radius transitions to form more than two tiers. For example, the crown internal radius transition 660 can have 2, 3, 4, 5, 6, or 7 tiers.

Figure 7:
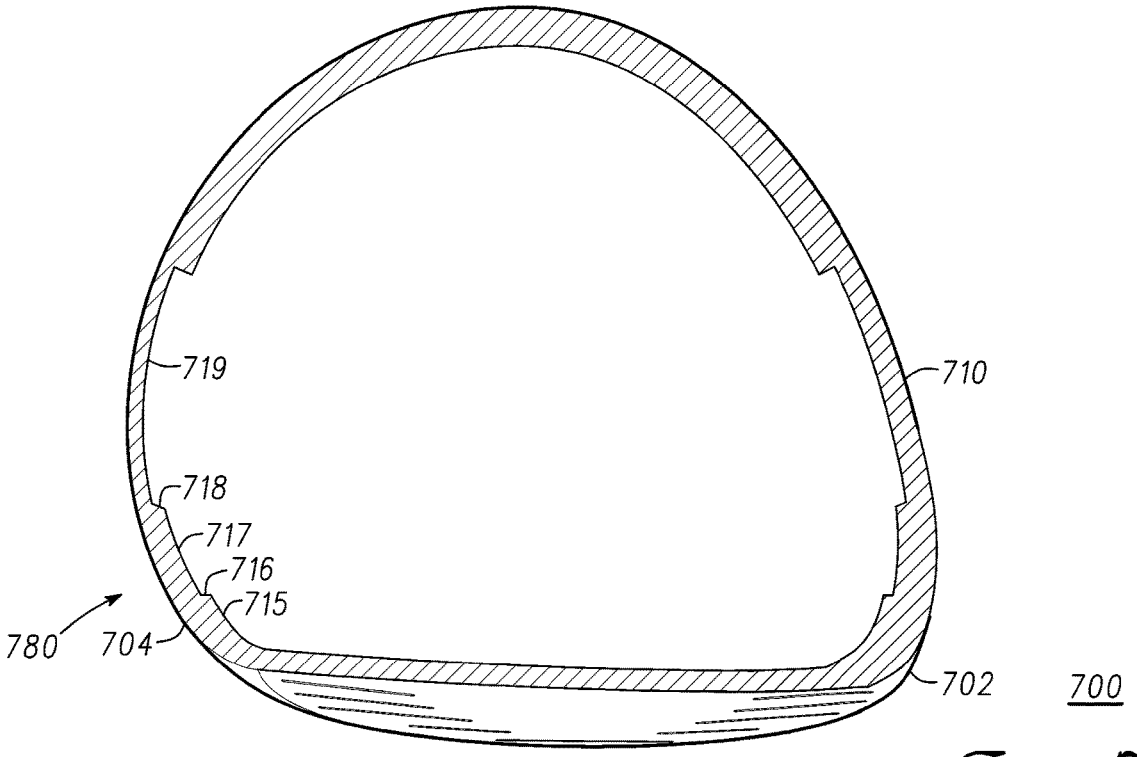
FIG. 7 depicts a cross-sectional view of a golf club similar to the golf club head of FIG. 1 along a similar cross-sectional line as the cross-sectional line VII-VII in FIG. 1, according to another embodiment.

In FIG. 7, a golf club head 700 can comprise a skirt internal radius transition 780 as shown in FIG. 7. FIG. 7 depicts a cross-sectional view of golf club 700 similar to golf club head 100 (FIG. 1) along a similar cross-sectional line as the cross-sectional line VII-VII in FIG. 1, according to another embodiment. Skirt internal radius transition 780 can be similar to internal radius transition 210 (FIG. 2), and first tier 715 can be similar to first tiers 315, 415, and/or 515 in FIGS. 3, 4, and 5, respectively; second tier 717 can be similar to second tiers 317, 417, and/or 517 in FIGS. 3, 4, and 5; third tier 719 can be similar to third tiers 419 and/or 519 in FIGS. 4 and 5, respectively; and tier transition regions 716 and/or 718 can be similar to tier transition regions 316, 416, 516, 418, and/or 518 in FIGS. 3, 4, and 5. Similarly, skirt internal radius transition 780 can have more than two tiers. For example, skirt internal radius transition 780 can have 2, 3, 4, 5, 6, or 7 tiers. As shown in FIG. 7, golf club head 700 also can comprise a skirt internal radius transition at the other side of strikeface 712. In another embodiment, golf club head 700 can comprise a skirt internal radius transition at a single side of strikeface 712.

Figure 8:
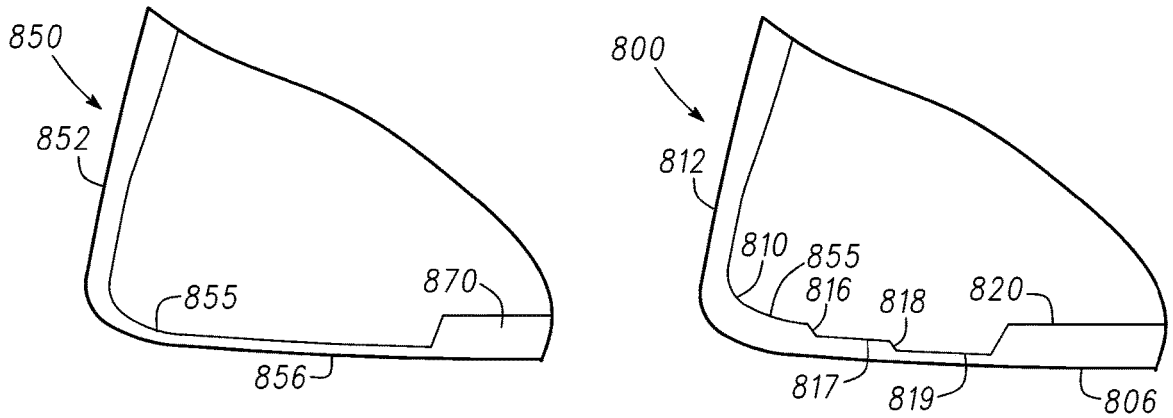
FIG. 8 depicts a view of a portion of a golf club head similar to the golf club head of FIG. 4, according to an embodiment, and a view of the same area of a standard golf club head.

FIG. 8 depicts a view of a portion of a golf club head 800 similar to golf club head 400 (FIG. 4), according to an embodiment, and a view of the same area of standard golf club head 850. Standard golf club head 850 comprises a uniform sole thickness 855 from a strikeface 852 to a sole 856, and an internal sole weight 870 that is thicker than a uniform sole thickness 855. Golf club head 800 comprises an internal radius transition 810 similar to internal radius transition 410 (FIG. 4). Internal radius transition 810 can comprise a first tier 815, similar to first tier 415 (FIG. 4), a second tier 817, similar to second tier 417 (FIG. 4), and a third tier 819, similar to third tier 419 (FIG. 4). Internal radius transition 810 also can comprise tier transition regions 816 and 818, similar to tier transition regions 416 (FIG. 4) and 418 (FIG. 4), and internal sole weight 820 that is similar to internal sole weight 870. In many embodiments, at least one of first tier 815, second tier 817, or third tier 819 can be thinner than uniform sole thickness 855. The thinness of the tiers can save weight that can then be redistributed in the club head.

There is a greater dispersion of higher stress over a greater area of sole 806 with internal transition region 810 than sole 856 without the cascading sole. In many embodiments, a general curve of a sole similar to uniform sole thickness 855 can absorb greater particular concentrations of impact force from a golf ball in particular regions, but will not disperse the force over a larger area. The cascading structure (or tiers of varying thickness along the internal radium transition), such as internal radius transition 810, however provides a technique to "package" the impact force from the golf ball over a larger area as the undulating or tier structure transfers higher stresses from one internal radium region of particular thickness to the next. In many embodiments, there is a bleeding, overflow, or pooling of the stress over internal radius transition 810 or the cascading thin sole. The greater dispersion of the greater stress force provides a greater recoiling force to the strikeface. The pooling of the stress over internal radius transition 810 also can prevent all of the stress from collecting directly at the thinnest tier. In many embodiments, the tiered features can help distribute the stress along the sole to prevent one large stress riser. Instead, there are multiple stress risers for a more even distribution of the stress. The stresses are extended along the cascading sole, allowing the sole to take on (or absorb) more stress. The stress, however, decreases at the thickest portion of the sole that without the cascading sole experiences the highest level of stress, and provides less spring back force to the strikeface.

An embodiment of a golf club head (e.g. 100, 300, 400, 500, 600, or 700) having the cascading sole was tested compared to a similar control club head devoid of a cascading sole. The club head with the cascading sole showed an increase in ball speed of approximately 0.5-1.5 miles per hour (mph) (0.8-2.4 kilometers per hour, kph), or approximately 0.5-0.9%, compared to the control club head. The increase in ball speed for center impacts was approximately 0.5-1.0 mph (0.8-1.6 kph), and the increase in ball speed for off-center impacts was approximately 1-1.5 mph (1.6-2.4 kph). The club head with the cascading sole further showed an increase in launch angle of approximately 0.1-0.3 degrees, a decrease in spin of approximately 275-315 revolutions per minute (rpm), and an increase in carry distance of approximately 3-6 yards (2.7-5.5 meters) compared to the control club head.

In some embodiments, the crown of a driver-type, hybrid-type, or wood-type golf club head having the cascading sole (e.g. 100, 300, 400, 500, 600, or 700) may further include a first crown thickness (not shown) and a second crown thickness (not shown). The first crown thickness may be positioned on the crown behind the strikeface or crown internal radius transition. The second crown thickness may be positioned on the crown behind the first crown thickness toward the rear of the club head. The first crown thickness is greater than the second crown thickness. Further, the first crown thickness may transition to the second crown thickness gradually according to any profile, or the first crown thickness may transition to the second crown thickness abruptly, such as with a step.

The first crown thickness may comprise any portion of the crown on a front end of the club head. For example, the first crown thickness may comprise 5%, 10%, 15%, 20%, 25%, 30%, 35%, 40%, 45%, 50%, or any other portion of the crown on the front end of the club head. The second crown thickness may comprise any portion of the crown on the rear of the club head. For example, the second crown thickness may comprise 40%, 45%, 50%, 55%, 60%, 65%, 70%, 75%, 80%, or any other portion of the rear of the club head.

The crown thickness may transition between the first crown thickness and the second crown thickness at any position on the crown of the club head, defining a crown thickness transition. The crown thickness transition may be any shape. In the exemplary embodiment, the crown thickness transition defines a bell-shaped curve, similar to the bell-shaped curve in U.S. Pat. No. 7,892,111, which is incorporated herein by reference. The first crown thickness is positioned on the crown between the strikeface and the bell-shaped curve, and the second crown thickness is positioned on the crown between the bell-shaped curve and the rear of the club head.

In the exemplary embodiment, the first crown thickness is approximately 0.022 inches (0.056 cm) and the second crown thickness is approximately 0.019 inches (0.048 cm) when the golf club head is a fairway wood type golf club head. Further, in the exemplary embodiment, the first crown thickness is approximately 0.024 inches (0.061 cm) and the second crown thickness is approximately 0.019 inches (0.048 inches) when the golf club head is a hybrid type golf club head.

In other embodiments of a fairway wood or hybrid type golf club head, the first crown thickness may be less than approximately 0.029 (0.074), 0.028 (0.071), 0.027 (0.069), 0.026 (0.066), 0.025 (0.064), 0.024 (0.061), 0.023 (0.058), 0.022 (0.056), 0.021 (0.053), 0.020 (0.051), 0.019 (0.048), 0.018 (0.046), or 0.017 (0.043) inches (cm), and the second crown thickness may be less than approximately 0.024 (0.061), 0.023 (0.058), 0.022 (0.056), 0.021 (0.053), 0.020 (0.051), 0.019 (0.048), 0.018 (0.046), 0.017 (0.043), 0.016 (0.041), 0.015 (0.038), 0.014 (0.036), 0.013 (0.033), or 0.012 (0.031) inches (cm).

The crown internal radius transition dissipates and/or reduces stresses on the crown of the club head, thereby allowing the first and the second crown thickness to be reduced compared to previous designs. In the exemplary embodiment, the first crown thickness is reduced by approximately 17.2-24.1%, and the second crown thickness is reduced by approximately 20.8% compared to previous designs. Reducing the first and the second crown thickness allows the center of gravity of the club head to be lowered (positioned closer to the sole) compared to previous designs. The lowered center of gravity of the club head improves the performance characteristics of the club head by reducing gearing and spin on the ball.

Figure 9:
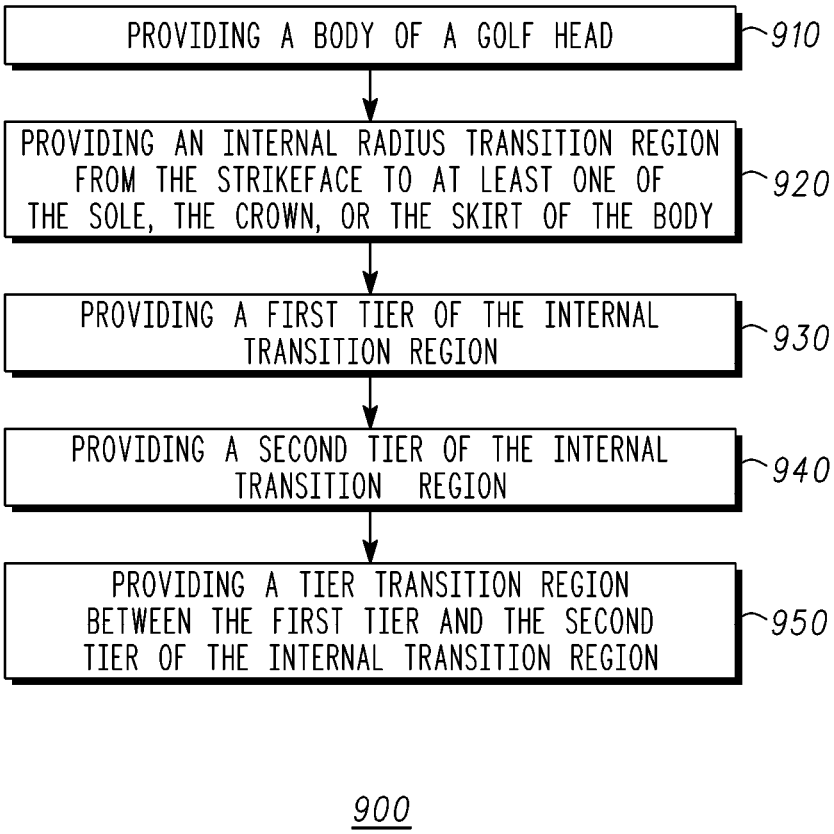
FIG. 9 depicts a method of manufacturing a golf club head according to an embodiment of a method.

Turning to FIG. 9, various embodiments of golf club heads with tiered internal thin sections include a method 900 for manufacturing a golf club head. Method 900 comprises providing a body (block 910). The body comprises a strikeface, a heel region, a toe region opposite the heel region, a sole, and a crown. In some embodiments, the body further comprises a skirt extending from the crown to the sole. Method 900 further comprises providing an internal radius transition region from the strikeface to at least one of the sole, the crown, or the skirt (block 920). Method 900 further comprises providing a first tier of the internal radius transition region (block 930), providing a second tier of the internal transition region (block 940), and providing a tier transition region between the first tier and the second tier of the internal transition region (block 950). In some embodiments, each of blocks 910, 920, 930, 940, and 950 can be performed simultaneously with each other such as by casting the body of a club head. In other embodiments, one or more of blocks 920, 930, 940, and/or 950 can be performed after block 910 through a machining process, as an example.

II. Golf Club Head with Back Cavity

In one embodiment, the golf club head has a back cavity located in an upper crown area of the golf club. In many embodiments, the back cavity can provide a box spring affect when striking a golf ball. The back cavity can be combined with varying thicknesses of the internal radius of the sole of the club head (cascading sole) to provide a spring like effect.

Some embodiments are directed to a club head (hybrid or fairway wood or iron with hollow design) that features a hollowed construction club head that provides a more "iron-like" look and feel. In some embodiments, the golf club head can feature a flat strikeface and iron-like profile, which can provide improved workability and accuracy, similar to an iron. A back cavity located below a top rail and along the upper crown of the club head has been designed for hybrids, fairway woods and irons with a hollow construction. The back cavity may be a full channel from the heel to the toe just below the top rail and along the upper crown or back portion of the club head. The top rail and the cavity may be any design. In some embodiments, the cavity is angled at approximately 90 degrees and provides a targeted hinge point in the crown region of the golf club head. This hinge or buckling region enables the top rail to absorb more of the impact force over a wider volumetric area causing the cavity and the top rail to act as a springboard by returning more recoiled force back to the strikeface as it returns to its original orientation thereby imparting more force into the ball. This greater club face deflection by the cavity design can lead to less spin, a higher loft angle of the golf ball upon impact, and greater ball speed with the same club speed over standard golf club heads.

In a standard hybrid club head, the top rail and upper crown regions do not have a cavity of this design. In comparison to the present disclosure, there is less club strikeface bending or deflection in such a standard hybrid club head. Standard hybrids are unable to have as great a spring-back effect because less energy is transferred to the top rail of the club due to the lack of a cavity. The disclosed golf club head with back cavity allows more of the impact force of the golf ball to be absorbed and then returned to the strikeface. In many embodiments, the angle of the cavity can provide a buckling point, or plastic hinge, or targeted hinge, for the strikeface to deflect more over the standard golf club.

The recoiling effect of the cavity on the strikeface provides: (1) a higher golf ball speed relative to the same club head speed of a club head with an upper crown cavity (or back cavity) and one without, due in part to the spring effect that is transferred from the hinged region to the strikeface to the ball; (2) less spin of the golf ball after impact with the club, due in part to the hinge point above the cavity counters more force being absorbed by the club and instead transfers more force to the ball thereby preventing the ball from spinning backward off the strikeface; (3) a higher loft angle to the golf ball upon impact, due to the hinge and strikeface acting as a diving board or catapult to the ball. In some embodiments, the cavity may provide an increase in ball speed of approximately 1.0-1.2%, and an increase in launch angle of approximately 0.4-0.7 degrees.

Figure 10:
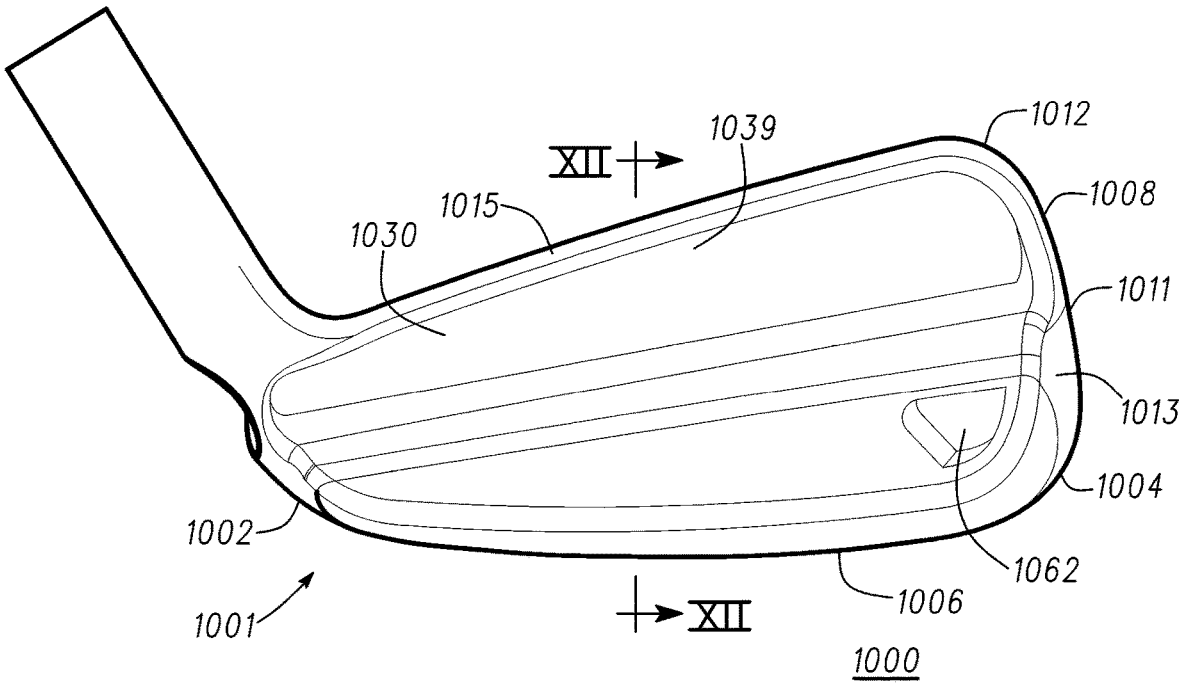
FIG. 10 depicts a back, toe-side perspective view of a golf club head according to an embodiment.
Figure 11:
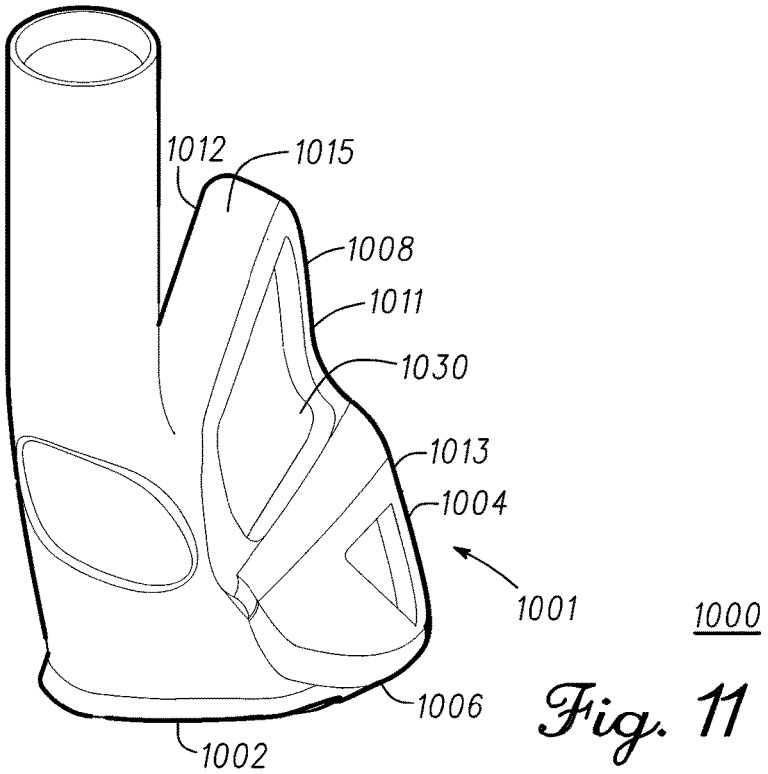
FIG. 11 depicts a back, heel-side perspective view of the golf club head according to the embodiment of FIG. 10.

Turning back to the drawings, FIG. 10 illustrates a back toe-side perspective view of an embodiment of golf club head 1000 and FIG. 11 illustrates a back heel-side perspective view of golf club head 1000 according to the embodiment of FIG. 10. Golf club head 1000 can be a hybrid-type golf club head. In other embodiments, golf club head 1000 can be an iron-type golf club head or a fairway wood-type golf club head. In many embodiments, golf club head 1000 does not include a badge or a custom tuning port.

Golf club head 1000 comprises a body 1001. In many embodiments, the body is hollow. In some embodiments, the body is at least partially hollow. Body 1001 comprises a strikeface 1012, a heel region 1002, a toe region 1004 opposite heel region 1002, a sole 1006, and a crown 1008. Crown 1008 comprises an upper region 1011 and a lower region 1013. Upper region 1011 comprises a top rail 1015. In some embodiments, top rail 1015 can be a flatter and taller top rail or skirt. The flatter and taller top rail can account for mishits on strikeface 1012 to increase playability off the tee.

In some embodiments, body 1001 can comprise stainless steel, titanium, aluminum, a steel alloy (e.g. 455 steel, 475 steel, 431 steel, 17-4 stainless steel, maraging steel), a titanium alloy (e.g. Ti 7-4, Ti 6-4, T-9S), an aluminum alloy, or a composite material. In some embodiments, strikeface 1012 can comprise stainless steel, titanium, aluminum, a steel alloy (e.g. 455 steel, 475 steel, 431 steel, 17-4 stainless steel, maraging steel), a titanium alloy (e.g. Ti 7-4, Ti 6-4, T-9S), an aluminum alloy, or a composite material. In some embodiments, body 1001 can comprise the same material as strikeface 1012. In some embodiments, body 1001 can comprise a different material than strikeface 1012.

In many embodiments, a cavity 1030 is located below top rail 1015. In many embodiments, cavity 1030 comprises a top rail box spring design. In many embodiments, top rail 1015 and cavity 1030 provide an increase in the overall bending of strikeface 1012. In some embodiments, the bending of strikeface 1012 can allow for an approximately 2% to approximately 5% increase of energy. The cavity 1030 allows for the strikeface 1012 to be thinner and allow additional overall bending. For some fairway wood-type golf club head embodiments, cavity 1030 can be a reverse scoop or indentation of crown 1008 with greater thickness toward sole 1006.

Referring to FIG. 10. in some embodiments, golf club head 1000 can further comprise an insert 1062 at lower region 1013 of crown 1008 towards toe region 1004. Some embodiments comprise an internal weight at sole 1006. In many embodiments, insert 1062 may be comprised of tungsten or some other high density material. In many embodiments, the insert shifts the center of gravity (CG) back from strikeface 1012 by approximately 0.04 inch (1 mm) to 0.10 inch (2.5 mm) and provides a 3.5% to 5.5% increase in launch angle, which can lead to an increase of playability off the tee and high or low mishits.

In many embodiments, the CG is in lower region 1013 of crown 1008, close to the intersection of toe region 1004 and sole 1006. In some embodiments, the CG of golf club head 1000 is 0.597 inches along the CGy plane and 0.541 inches along the CGz plane. For the moment of inertia, Ixx, there was a 20.5% increase over the G30 iron and a 28% increase over the Rapture DI by golf club head 1000. For Iyy, there was a 1.7% increase over the G30 iron and a 22% increase over Rapture DI.

In some embodiments, approximately 3 grams (g) to approximately 4 g is added to top rail 1015. In most embodiments, the overall mass of golf club head 1000 remains the same. In some embodiments, mass can be removed from sole 1006 or toe region 1004 to offset the addition of mass to top rail 1015. In some embodiments, adding the approximately 3 g to approximately 4 g of mass to top rail 1015 can assist in the golf club head resisting turning. In some embodiments, the CG of the golf club head is slightly raised.

Figure 12:
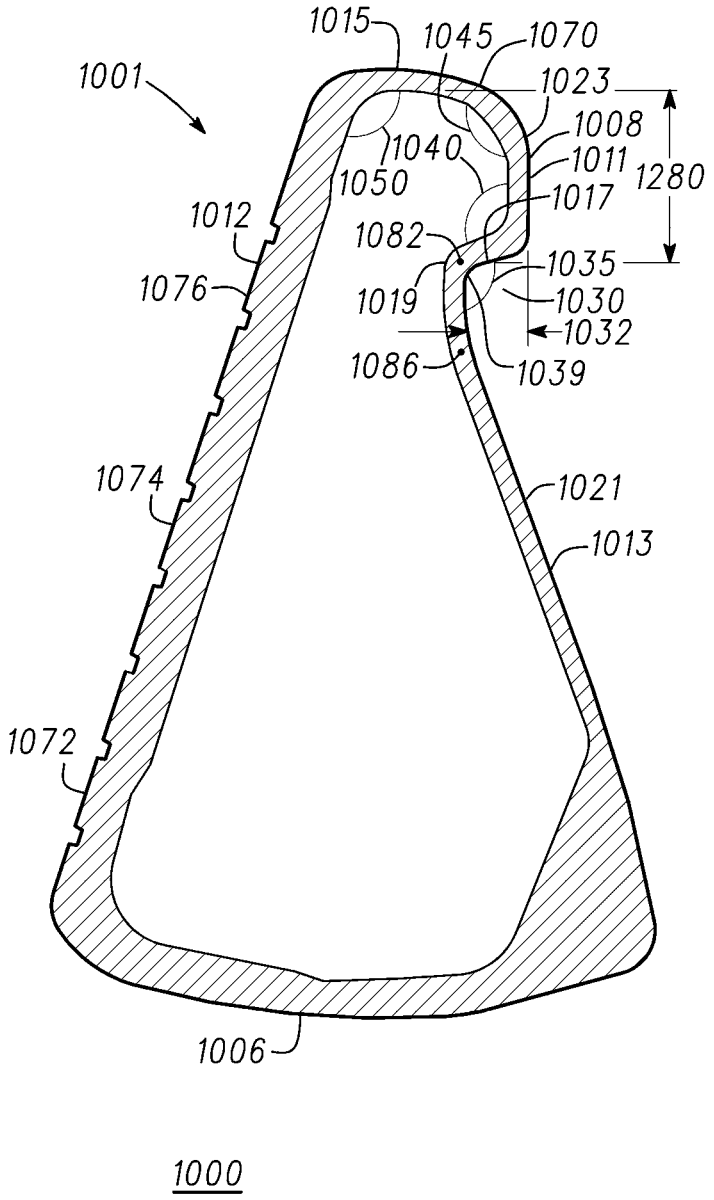
FIG. 12 depicts a cross-sectional view of the golf club head of FIG. 10 along the cross-sectional line XII-XII of FIG. 10.

FIG. 12 illustrates a cross-section of golf club head 1000 along the cross-sectional line XII-XII in FIG. 10, according to one embodiment. As seen in FIG. 12, strikeface 1012 comprises a high region 1076, a middle region 1074, and a low region 1072. In many embodiments, upper region 1011 of crown 1008 comprises a rear wall 1023, a top wall 1017 of cavity 1030 below and adjacent to rear wall 1023, and a back wall 1019 of cavity 1030 below and adjacent to top wall 1017.

In some embodiments, a height 1280 of rear wall 1023 of the upper region 1011 of crown 1008 can be approximately 0.125 inch (0.318 cm) to approximately 0.75 inch (1.91 cm), or approximately 0.150 inch (0.381 cm) to approximately 0.400 inch (1.02 cm). For example, in some embodiments, the height 1280 of rear wall 1023 of the upper region 1011 of crown 1008 can be approximately 0.175 inch (0.445 cm), 0.275 inch (0.699 cm), 0.375 inch (0.953 cm), 0.475 inch (1.21 cm), 0.575 inch (1.46 cm), or 0.675 inch (1.71 cm). In some embodiments, the height 1280 of rear wall 1023 of the upper region 1011 of crown 1008 can be approximately 5% to approximately 25% of the height of golf club head 1000. In some embodiments, the length of top rail 1015, measured from heel region 1002 to toe region 1004, can be approximately 70% to approximately 95% of the length of golf club head 1000.

The height 1280 of rear wall 1023 of the upper region 1011 of crown 1008, as described herein, allows cavity 1030 to absorb at least a portion of the stress on strikeface 1012 during impact with a golf ball. A golf club head having a rear wall height greater than the rear wall height 1280 described herein would absorb less stress (and allow less strikeface deflection) on impact than the golf club head 1000 described herein, due to increased dispersion of the impact stress along the top rail prior to reaching the cavity.

In some embodiments, cavity 1030 is located above lower region 1013 of crown 1008 and is defined at least in part by upper region 1011 and lower region 1013 of crown 1008. Cavity 1030 comprises a top wall 1017, a back wall 1019, and a bottom incline 1021. A first inflection point 1082 is located between top wall 1017 of cavity 1030 and rear wall 1019 of cavity. A second inflection point 1086 is located between rear wall 1019 of cavity 1030 and bottom incline 1021.

In some embodiments, the height of back wall 1019, measured from first inflection point 1082 to second inflection point 1086, can be approximately 0.010 inch (0.25 mm) to approximately 0.138 inch (3.5 mm), or approximately 0.010 inch (0.25 mm) to approximately 0.059 inch (1.5 mm). For example, the height of back wall 1019 can be approximately 0.01 inch (0.25 mm), 0.02 inch (0.5 mm), 0.03 inch (0.75 mm), 0.04 inch (1.0 mm), 0.05 inch (1.25 mm), 0.06 inch (1.5 mm), 0.07 inch (1.75 mm), 0.08 inch (2.0 mm), 0.09 inch (2.25 mm), 0.10 inch (2.5 mm), 0.11 inch (2.75 mm), 0.012 inch (3.0 mm), 0.13 inch (3.25 mm), or 0.14 inch (3.5 mm). In many embodiments, an apex of top wall 1017 can be approximately 0.125 inch (0.318 cm) to approximately 1.25 inches (3.18 cm) or approximately 0.25 inch (0.635 cm) to approximately 1.25 inches (3.18 cm) below an apex of top rail 1015. For example, the apex of top wall 1017 can be approximately 0.125 inch (0.318 cm), 0.25 inch (0.635 cm), 0.375 inch (0.953 cm), 0.5 inch (1.27 cm), 0.625 inch (1.59 cm), 0.75 inch (1.91 cm), 0.825 inch (2.10 cm), 1.0 inch (2.54 cm), 1.125 inches (2.88 cm), or 1.25 inches (3.18 cm) below the apex of top rail 1015.

In many embodiments, back wall 1019 of cavity 1030 can be substantially parallel to strikeface 1012. In other embodiments, back wall 1019 is not substantially parallel to strikeface 1012. In many embodiments, top wall 1017 of cavity is angled toward strikeface 1012 when moving toward the first inflection point 1082. This orientation of top wall 1017 creates a buckling point or hinge point or plastic hinge to direct the stress of impact toward cavity 1030 and allowing increased flexing of strikeface 1012 during impact.

Lower region 1013 of crown 1008 comprises bottom incline 1021 of cavity 1030. In many embodiments, the second inflection point 1086, adjacent to bottom incline 1021, can be at least approximately 0.25 inch (0.635 cm) to approximately 2.0 inches (5.08 cm), or approximately 0.5 inch (1.27 cm) to approximately 1.5 inches (3.81 cm) below the apex of top rail 1015. For example, the second inflection point 1086 can be at least approximately 0.25 inch (0.635 cm), 0.5 inch (1.27 cm), 0.75 inch (1.91 cm), 1.0 inch (2.53 cm), 1.25 inches (3.18 cm), 1.5 inches (3.81 cm), 1.75 inches (4.45 cm) or 2.0 inches (5.08 cm) below the apex of top rail 1015. In some embodiments, the maximum height of the bottom incline, measured from the sole 1006 of the club head 1000 to the second inflection point 1086, can be at least approximately 0.25 inch (0.635 cm) to approximately 3 inches (7.62 cm), or approximately 0.50 inch (1.27 cm) to approximately 2 inches (5.08 cm) above a lowest point of the sole 1006. For example, the second inflection point 1086 can be at least approximately 0.25 inch (0.635 cm), 0.375 inch (0.953 cm), 0.5 inch (1.27 cm), 0.625 inch (1.59 cm), 0.75 inch (1.91 cm), 0.825 inch (2.10 cm), 1.0 inch (2.54 cm), 1.125 inches (2.88 cm), 1.25 inches (3.18 cm), 1.375 inches (3.49 cm), 1.5 inches (3.81 cm), 1.625 inches (4.12 cm), 1.75 inches (4.45 cm), 1.875 inches (4.76 cm), 2.0 inches (5.08 cm), 2.125 inches 5.40 cm), 2.25 inches (5.71 cm), 2.375 inches (6.03 cm), 2.5 inches (6.35 cm), 2.625 inches (6.67 cm), 2.75 inches (7.00 cm), 2.875 inches (7.30 cm), or 3.0 inches (7.62 cm) above a lowest point of the sole.

Cavity 1030 further comprises at least one channel 1039 (FIG. 10). In many embodiments, channel 1039 extends from heel region 1002 to toe region 1004. A channel width 1032 (FIG. 12) can be substantially constant throughout channel 1039. In some embodiments, channel width 1032 (FIG. 12) can be approximately 0.008 inch (0.2 mm) to approximately 1 inch (25 mm), or approximately 0.008 inch (0.2 mm) to approximately 0.31 inch (8 mm). For example, channel width 1032 can be approximately 0.008 inch (0.2 mm), 0.016 inch (0.4 mm), 0.024 inch (0.6 mm), 0.031 inch (0.8 mm), 0.039 inch (1.0 mm), 0.079 inch (2 mm), 0.12 inch (3 mm), 0.16 inch (4 mm), 0.20 inch (5 mm), 0.24 inch (6 mm), 0.28 inch (7 mm), 0.31 inch (8 mm), 0.39 inch (10 mm), 0.59 inch (15 mm), 0.79 inch (20 mm), or 0.98 inch (25 mm). In other embodiments, a channel toe region width of channel 1039 is smaller than a channel heel region width of channel. In other embodiments, the channel heel region width is smaller than the channel toe region width. In other embodiments, a channel middle region width of channel 1039 can be smaller than at least one of the channel heel region width or the channel toe region width. In other embodiments, the channel middle region width can be greater than at least one of the channel heel region width or the channel toe region width. In some embodiments, channel 1039 is symmetrical. In other embodiments, channel 1039 is non-symmetrical. In other embodiments, channel 1039 can further comprise at least two partial channels. In some embodiments, channel 1039 can comprise a series of partial channels interrupted by one or more bridges. In some embodiments, the one or more bridges can be approximately the same thickness as the thickness of upper region 1011 of crown 1008.

The channel width 1032, as described herein, allows absorption of stress from strikeface 1012 on impact. A golf club head having a channel width less than the channel width described herein (e.g. a golf club head with a less pronounced cavity) would allow less stress absorption from the strikeface on impact (due to less material on the upper region 1011 of crown 1008), and therefore would experience less strikeface deflection than the golf club head 1000 described herein.

In many embodiments, cavity 1030 further comprises a back cavity angle 1035. Back cavity angle is measured between top wall 1017 and back wall 1019 of cavity 1030. In many embodiments, back cavity angle 1035 can be approximately 70 degrees to approximately 110 degrees. In some embodiments, back cavity angle 1035 can be approximately 80 degrees to approximately 100 degrees. In some embodiments, back cavity angle 1035 is approximately 70, 75, 80, 85, 90, 95, 100, or 110 degrees. In many embodiments, back cavity angle 1035 provides a buckling point or plastic hinge or targeted hinge at a top rail hinge point 1070, upon golf club head 1000 impacting the golf ball. In some embodiments, the wall thickness at top rail hinge point 1070 is thinner than at top wall 1017 of cavity 1030

Figure 13:
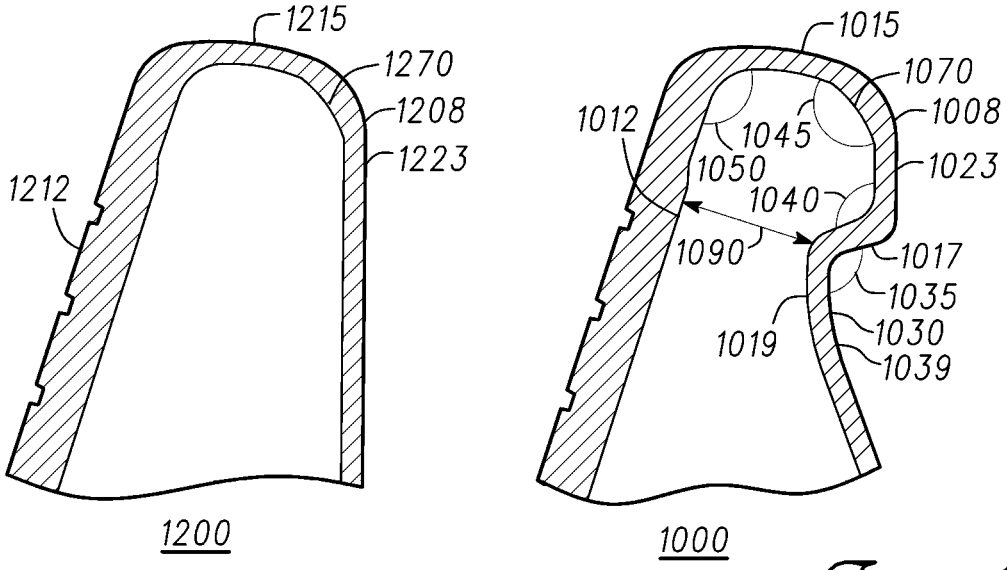
FIG. 13 depicts a view of a portion of the golf club head of FIG. 12 and a view of the same area of a standard golf club head.

FIG. 13 illustrates a view of crown 1008 of the cross-section of golf club head 1000 of FIG. 12 alongside a similar cross-section of a golf club head 1200 without a cavity along a similar cross-sectional line XII-XII in FIG. 10. In many embodiments, golf club head 1000 comprises a rear angle 1040, a top rail angle 1045, and a strikeface angle 1050. Upper region angle 1040 is measured from top wall 1017 to rear wall 1023 of upper region 1011. In many embodiments, rear angle 1040 can be approximately 70 degrees to approximately 110 degrees. In some embodiments, rear angle 1040 is approximately 90 degrees. Top rail angle 1045 is measured from rear wall 1023 of upper region 1011 to top rail 1015. In many embodiments, top rail angle 1045 can be approximately 35 degrees to approximately 120 degrees or 70 degrees to approximately 110 degrees. In some embodiments, top rail angle 1045 can be approximately 35, 40, 45, 50, 55, 60, 65, 70, 75, 80, 85, 90, 95, 100, 105, 110, 115, or 120 degrees. Strikeface angle 1050 is measured from strikeface 1012 to top rail 1015. In many embodiments, strikeface angle 1050 can be approximately 70 degrees to approximately 160 degrees or 70 degrees to approximately 110 degrees. In some embodiments, strikeface angle 1050 is approximately 70, 75, 80, 85, 90, 95, 100, 105, 110, 115, 120, 125, 130, 135, 140, 145, 150, 155, or 160 degrees.

Referring to FIG. 13, in some embodiments, a minimum gap 1090 between strikeface 1012 and back wall 1019 is approximately 0.079 inch (2 mm) to approximately 0.39 inch (10 mm). For example, the minimum gap 1090 between strikeface 1012 and back wall 1019 can be approximately 0.079 inch (2 mm), 0.16 inch (4 mm), 0.24 inch (6 mm), 0.31 inch (8 mm), or 0.39 inch (10 mm). In some embodiments, the minimum gap 1090 between the strikeface 1012 and back wall 1019 is less than approximately 0.55 inch (14 mm), less than approximately 0.47 inch (12 mm), less than approximately 0.39 inch (10 mm), less than approximately 0.31 inch (8 mm), less than approximately 0.24 inch (6 mm), or less than approximately 0.16 inch (4 mm). Further, in some embodiments, a maximum gap between strikeface 1012 and rear wall 1023 of upper region 1011 of golf club head 1000 is greater than minimum gap 1090. Further still, in some embodiments, a maximum gap between strikeface 1012 and bottom incline 1021 in lower region 1013 of golf club head 1000 is greater than minimum gap 1090 and maximum gap in upper region 1011.

Figure 21:
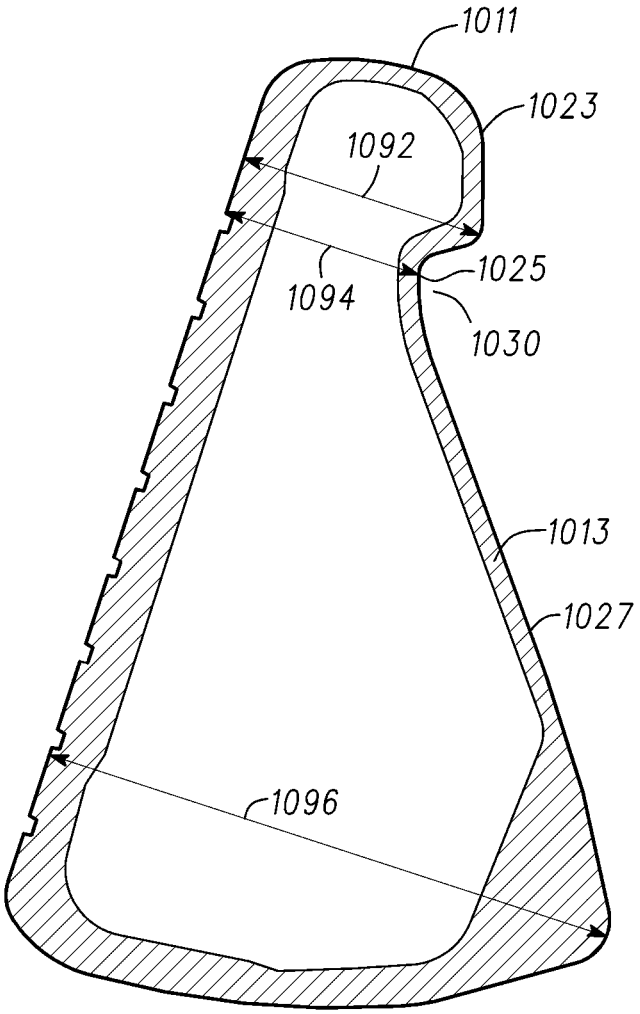
FIG. 21 depicts a cross sectional view of the golf club head of FIG. 10.

FIG. 21 illustrates a cross-sectional view of golf club head 1000, similar to the cross-section of the golf club head 1000 illustrated in FIG. 12. Golf club head 1000 includes cavity 1030, upper region 1011, and lower region 1013. Upper region 1011 includes upper exterior rear wall 1023, cavity 1030 includes cavity exterior wall 1025, and lower region 1013 includes lower exterior wall 1027. In many embodiments, a maximum upper distance 1092 measured as the perpendicular distance from the strikeface 1012 to the rear wall 1023 of upper region 1011 can be approximately 0.20-0.59 inch (5-15 mm). For example, maximum upper distance 1092 can be approximately 0.20 inch (5 mm), 0.24 inch (6 mm), 0.28 inch (7 mm), 0.31 inch (8 mm), 0.35 inch (9 mm), 0.39 inch (10 mm), 0.43 inch (11 mm), 0.47 inch (12 mm), 0.51 inch (13 mm), 0.55 inch (14 mm), or 0.59 inch (15 mm). Further, a minimum cavity distance 1094 measured as the perpendicular distance from the strikeface 1012 to the cavity exterior wall 1025 can be approximately 0.16-0.47 inch (4-12 mm). For example, minimum cavity distance 1094 can be approximately 0.16 inch (4 mm), 0.20 inch (5 mm), 0.24 inch (6 mm), 0.28 inch (7 mm), 0.31 inch (8 mm), 0.35 inch (9 mm), 0.39 inch (10 mm), 0.43 inch (11 mm), or 0.47 inch (12 mm). Further still, a maximum lower distance 1096 measured as the perpendicular distance from the strikeface 1012 to the lower exterior wall 1027 can be approximately 0.98-1.57 inch (25-40 mm). For example, maximum lower distance 1096 can be approximately 0.98 inch (25 mm), 1.02 inch (26 mm), 1.06 inch (27 mm), 1.10 inch (28 mm), 1.14 inch (29 mm), 1.18 inch (30 mm), 1.22 inch (31 mm), 1.26 inch (32 mm), 1.30 inch (33 mm), 1.34 inch (34 mm), 1.38 inch (35 mm), 1.42 inch (36 mm), 1.46 inch (37 mm), 1.50 inch (38 mm), 1.54 inch (39 mm), 1.57 inch or (40 mm). In many embodiments, maximum lower distance 1096 is greater than maximum upper distance 1092, and maximum upper distance 1092 is greater than minimum cavity distance 1094.

In many embodiments, cavity 1030 can provide an increase in golf ball speed over golf club head 1200 or other standard golf club heads, can reduce the spin rate of standard hybrids club heads, and can increase the launch angle over both the standard hybrid and iron club heads. In many embodiments, the shape of cavity 1035 determines the level of spring and timing of the response of golf club head 1000. When the golf ball impacts strikeface 1012 of club head 1000 with cavity 1030, strikeface 1012 springs back like a drum, and crown 1008 bends in a controlled buckle manner. In many embodiments, top rail 1015 can absorb more stress over greater volumetric space than a top rail in a golf club head without cavity 1030. The length, depth and width of cavity 1030 can vary. These parameters provide control regarding how much spring back is present in the overall design of club head 1000.

Upon impact with the golf ball, strikeface 1012 can bend inward at a greater distance than on a golf club without cavity 1030. In some embodiments, strikeface 1012 has an approximately 10% to approximately 50% greater deflection than a strikeface on a golf club head without cavity 1030. In some embodiments, strikeface 1012 has an approximately 5% to approximately 40% or approximately 10% to approximately 20% greater deflection than a strikeface on a golf club head without cavity 1035. For example, strikeface 1012 can have an approximately 5%, 10%, 15%, 20%, 25%, 30%, 35% or 40% greater deflection than a strikeface on a golf club head without cavity 1035. In many embodiments, there is both a greater distance of retraction by strikeface 1012 due to the hinge and bending of cavity 1030 over a standard strikeface that does not have a back portion of the club without the cavity.

In many embodiments, the face deflection is greater with club head 1000 having cavity 1030, as a greater buckling occurs along top rail hinge point 1070 upon impact with the golf ball. Cavity 1030, however, provides a greater dispersion of stress along top rail hinge point 1070 region of the top rail and the spring back force is transferred from cavity 1030 and top rail 1015 to strikeface 1012. A standard top rail without a cavity does not have this hinge/buckling effect, nor does it absorb a high level of stress over a large volumetric area of the top rail. Therefore, the standard strikeface does not contract and then recoil as much as strikeface 1012. Further, both a larger region of strikeface 1012 and top rail 1015 absorb more stress than the same crown region of a standard golf club head with a standard top rail and no cavity. In many embodiments, although there is greater stress along a greater area above cavity 1030 than the same area in a standard club without the cavity, the durability of the club head with and without the cavity is the same. By adding more spring to the back end of the club (due to the inward inclination of top wall 1017 toward strikeface 1012), more force is displaced throughout the volume of the structure. The stress is observed over a greater area of strikeface 1012 and top rail 1015 of golf club head 1000. Peak stresses can be seen in the standard top rail club head. However, more peak stresses are seen in golf club head 1000, but distributed over a large volume of the material. The hinge and bend regions of golf club head 1000 (i.e., the region above cavity 1030 and cavity 1030 itself) will not deform as long as the stress does not meet the critical buckling threshold. Cavity 1030 and its placement can be design to be under the critical K value of the buckling threshold.

Figure 24:
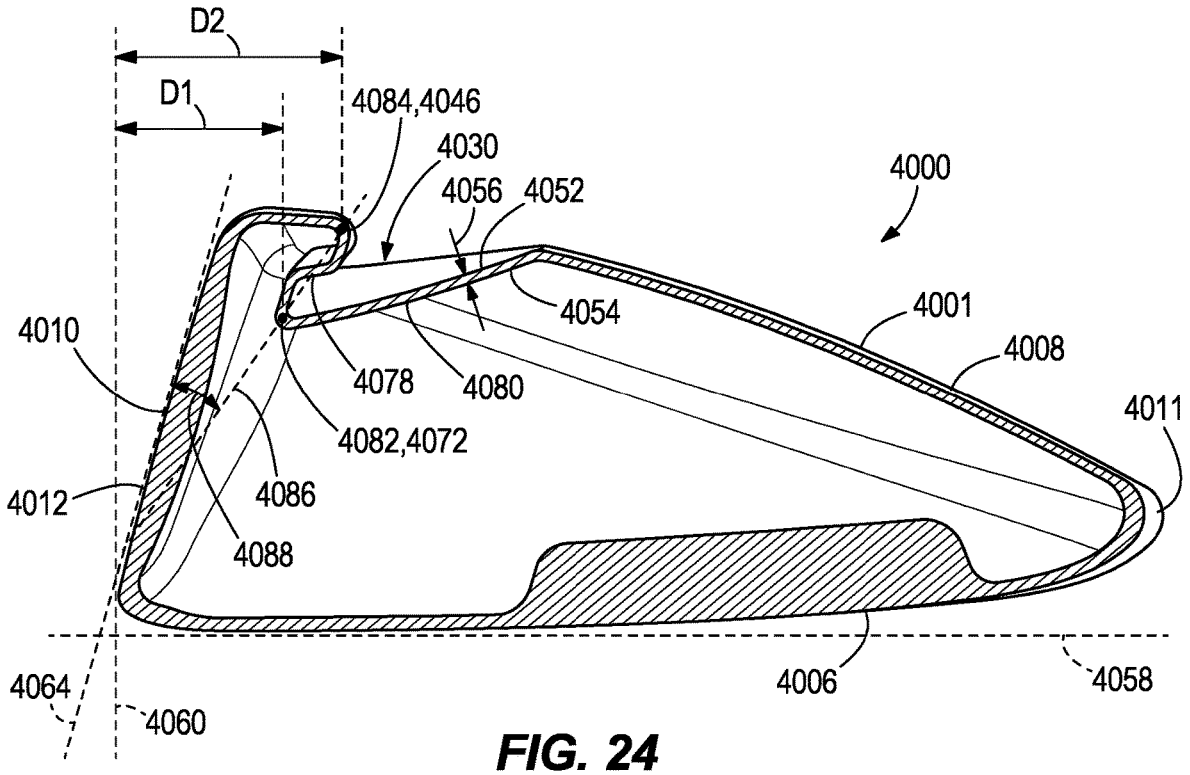
FIG. 24 depicts a cross-sectional view of another exemplary golf club head according to the embodiment of FIG. 22.
Figure 24A:
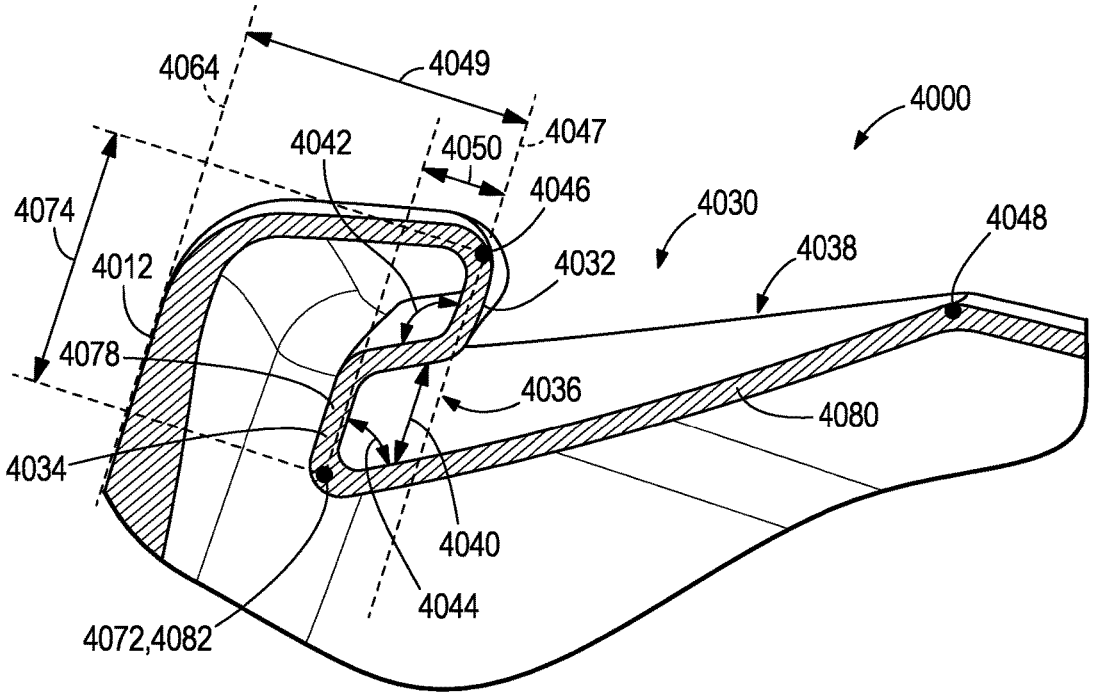
FIG. 24A depicts an enlarged view of a portion of the cross-sectional view of the exemplary golf club head of FIG. 24.
Figure 25:
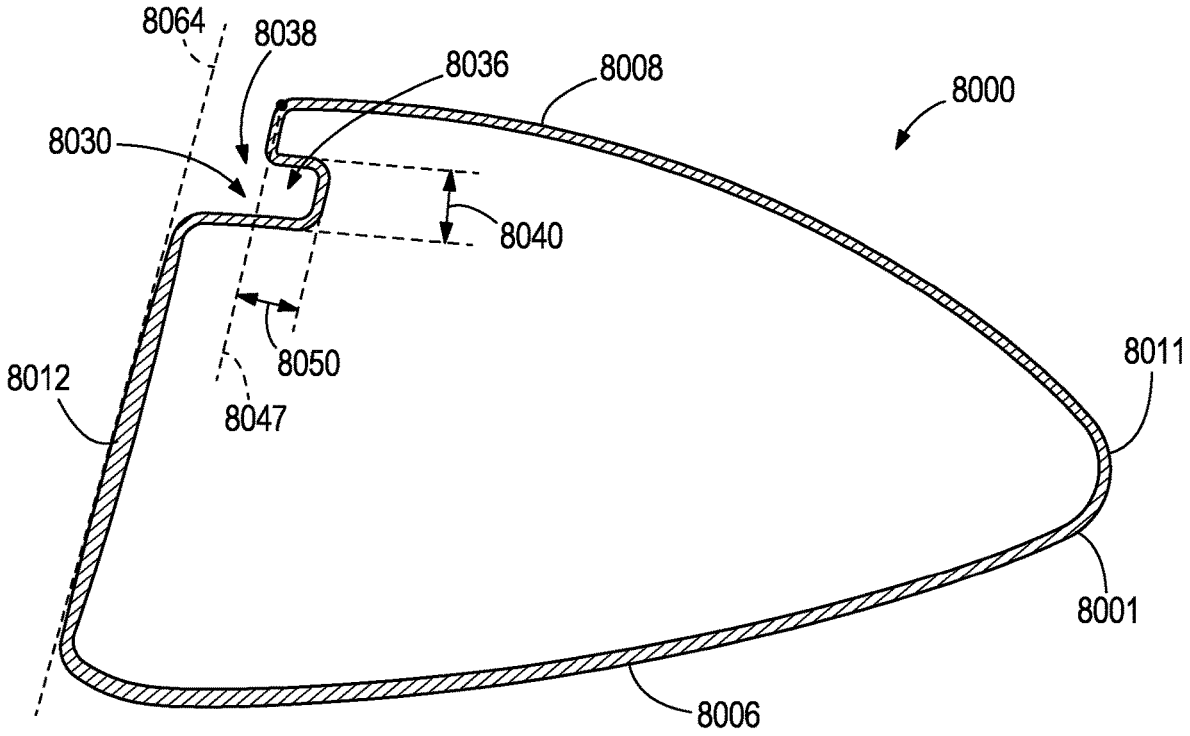
FIG. 25 depicts a cross-sectional view of another exemplary golf club head according to the embodiment of FIG. 22.
Figure 26:
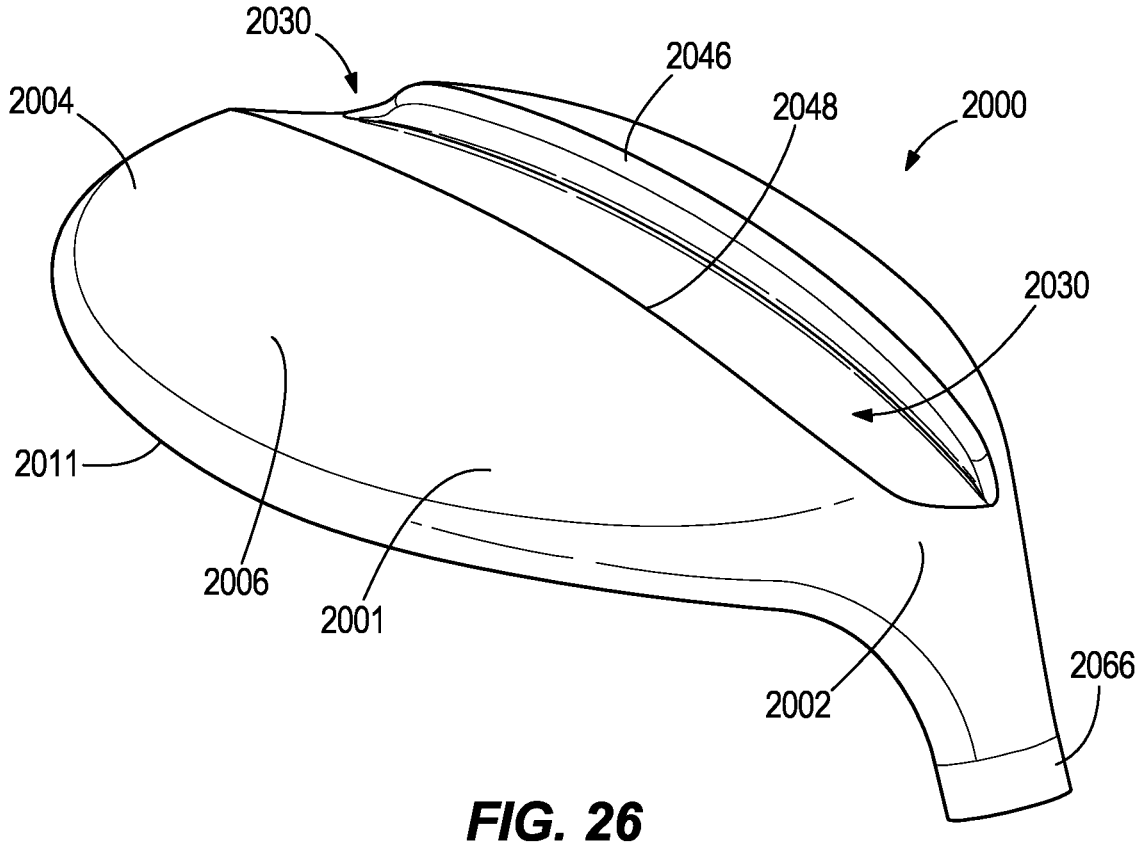
FIG. 26 depicts a rear perspective view of another exemplary golf club head according to the embodiment of FIG. 22.
Figure 27:
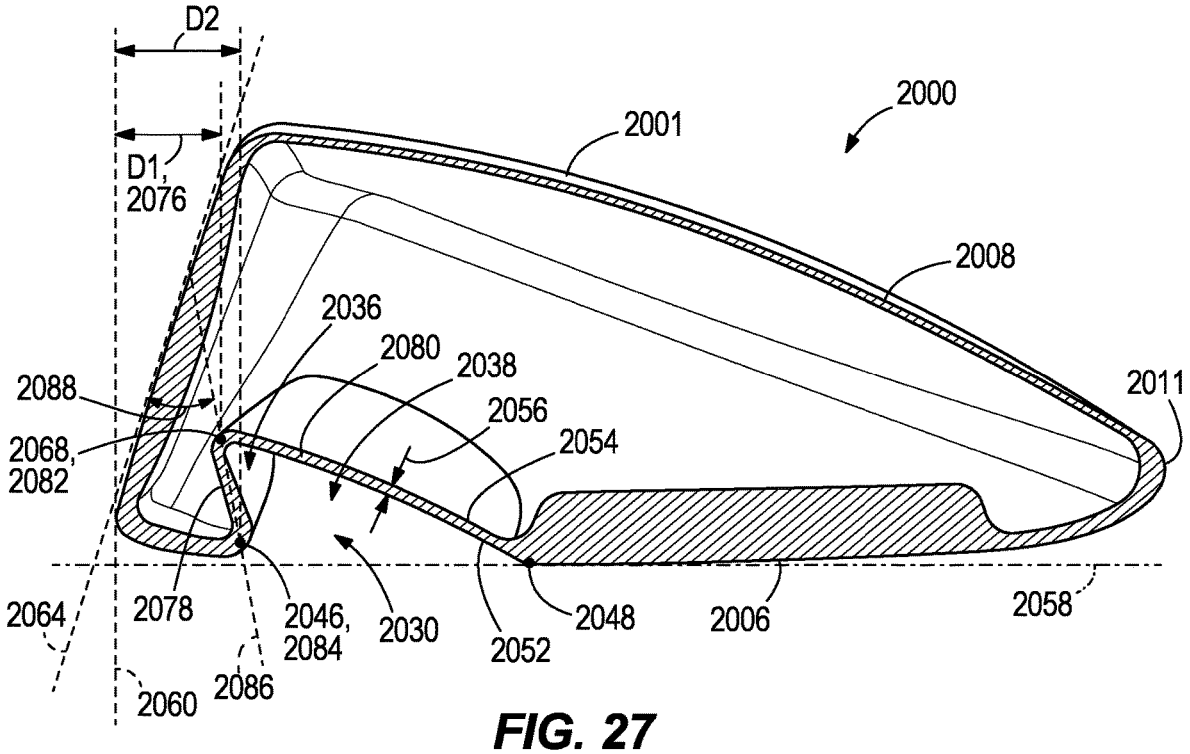
FIG. 27 depicts a cross-sectional view of the exemplary golf club head of FIG. 26.
Figure 27A:
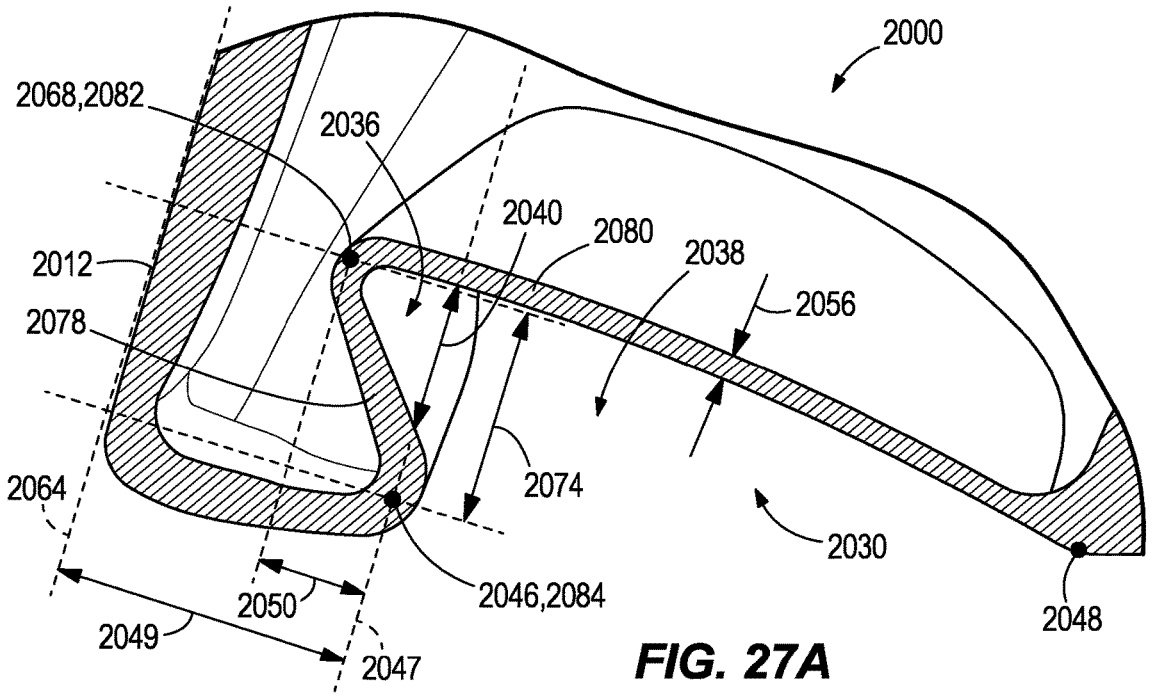
FIG. 27A depicts an enlarged view of a portion of the cross-sectional view of the exemplary golf club head of FIG. 27.

FIGS. 22-30 illustrate various examples of another embodiment of a golf club head 2000, 3000, 4000, 5000, 6000, 7000, 8000 having a cavity 2030, 3030, 4030, 5030, 6030, 7030, 8030 for increased face deflection. Referring to FIGS. 26 and 27, golf club head 2000 comprises a strikeface 2012 and a body 2001 having a heel region 2002, a toe region 2004 opposite heel region 2002, a sole 2006, a crown 2008 opposite sole 2006, a front end 2010, a rear end 2011 opposite front end 2010, and a cavity 2030.

In many embodiments, the golf club head 2000 is a hollow body type golf club head, such as a hybrid-type golf club head, a fairway wood-type golf club head, or a driver-type golf club head. In some embodiments, the golf club head 2000 can be an iron-type club head or can be at least partially hollow, similar to club head 1000 described above.

In embodiments where the club head 2000 is a driver-type club head, the loft angle of the club head 2000 can be less than 16 degrees, less than 15 degrees, less than 14 degrees, less than 13 degrees, less than 12 degrees, less than 11 degrees, or less than 10 degrees. Further, in many embodiments, the volume of the club head 2000 can be greater than 400 cc, greater than 425 cc, greater than 450 cc, greater than 475 cc, greater than 500 cc, greater than 525 cc, greater than 550 cc, greater than 575 cc, greater than 600 cc, greater than 625 cc, greater than 650 cc, greater than 675 cc, or greater than 700 cc.

In embodiments where the club head 2000 is a fairway wood-type club head, the loft angle of the club head 2000 can be less than 35 degrees, less than 34 degrees, less than 33 degrees, less than 32 degrees, less than 31 degrees, or less than 30 degrees. Further, the loft angle of the club head 2000 can be greater than 12 degrees, greater than 13 degrees, greater than 14 degrees, greater than 15 degrees, greater than 16 degrees, greater than 17 degrees, greater than 18 degrees, greater than 19 degrees, or greater than 20 degrees. In these embodiments, the volume of the club head 2000 can be less than 400 cc, less than 375 cc, less than 350 cc, less than 325 cc, less than 300 cc, less than 275 cc, less than 250 cc, less than 225 cc, or less than 200 cc. Further, in these embodiments, the volume of the club head can be 300 cc-400 cc, 325 cc-400 cc, 350 cc-400 cc, 250 cc-400 cc, 250-350 cc, or 275-375 cc.

In embodiments where the club head 2000 is a hybrid-type club head, the loft angle of the club head 2000 can be less than 40 degrees, less than 39 degrees, less than 38 degrees, less than 37 degrees, less than 36 degrees, less than 35 degrees, less than 34 degrees, less than 33 degrees, less than 32 degrees, less than 31 degrees, or less than 30 degrees. Further, the loft angle of the club head 2000 can be greater than 16 degrees, greater than 17 degrees, greater than 18 degrees, greater than 19 degrees, greater than 20 degrees, greater than 21 degrees, greater than 22 degrees, greater than 23 degrees, greater than 24 degrees, or greater than 25 degrees. In these embodiments, the volume of the club head 900 can be less than 200 cc, less than 175 cc, less than 150 cc, less than 125 cc, less than 100 cc, or less than 75 cc. Further, in these embodiments, the volume of the club head can be 100 cc-150 cc, 75 cc-150 cc, 100 cc-125 cc, or 75 cc-125 cc.

In embodiments where the club head 2000 is an iron-type club head, the loft angle of the club head 2000 can be less than 35 degrees, less than 30 degrees, less than 29 degrees, less than 28 degrees, less than 27 degrees, less than 26 degrees, less than 25 degrees, or less than 24 degrees. Further, the loft angle of the club head 2000 can be greater than 12 degrees, greater than 13 degrees, greater than 14 degrees, greater than 15 degrees, greater than 16 degrees, greater than 17 degrees, or greater than 18 degrees. In these embodiments, the volume of the club head 2000 can be less than 100 cc, less than 75 cc, less than 60 cc, less than 55 cc, or less than 50 cc. Further, in these embodiments, the volume of the club head can be 25 cc-75 cc, 25 cc-50 cc, 40 cc-60 cc, 45 cc-60 cc, or 40 cc-50 cc.

In many examples, cavity 2030 can be described with reference to a ground plane 2058, a front plane 2060, and a loft plane 2064 when the club head is at an address position. In the address position, a hosel axis (not shown) extending centrally through the hosel 2066 is positioned at a 60 degree angle to the ground plane 2058 when viewed from a front view, and at a 90 degree angle to the ground plane 2058 when viewed from a side view. The front plane 2060 is positioned perpendicular to the ground plane 2058, adjacent to the forward most point of the club head 2000. The loft plane 2064 is positioned tangent to a geometric center of the strikeface 2012.

Referring to FIGS. 26 and 27, in the illustrated embodiment, the cavity 2030 is located behind the strikeface 2012 on the sole 2006 of the club head. In these or other embodiments, cavity 2030 can reduce impact stress on the strikeface 2012, resulting in the ability to reduce strikeface thickness. Further, in these or other embodiments, cavity 2030 can increase strikeface deflection on impact with a golf ball, resulting in increased ball speed and travel distance. In other embodiments, the cavity 2030 can be positioned on any suitable area of club head 2000, such as the sole 2006, the crown 2008, or a combination of the sole 2006 and the crown 2008. For example, in other embodiments, cavity 2030 can be located on the crown 2008 of club head 2000. For further example, cavity 2030 can be located on at least a portion of the strikeface 2012 near the sole 2006. For further example, cavity 2030 can be located on both the crown 2008 and the sole 2006 of the club head 2000.

In many examples, cavity 2030 extends from near heel portion 2002 to near toe portion 2004 of the club head 2000. Further, in many examples, cavity 2030 can be centered between heel portion 2002 and toe portion 2004 of the club head 2000. In other examples, cavity 2030 can extend any distance along club head 2000 from heel portion 2002 to toe portion 2004. Further, in other examples, cavity 2030 can be offset toward heel portion 2002, or offset toward toe portion 2004 of club head 2000.

In other examples, cavity 2030 can comprise a plurality of discrete portions (not shown). For example, cavity can comprise a first cavity portion (not shown) positioned near the toe portion 2004 of the club head and a second cavity portion (not shown) positioned near the heel portion 2002 of the club head. In these examples, cavity 2030 can comprise any number of discrete portions, such as 1, 2, 3, 4, 5, 6, 7, 8, 9, 10, or any other number of discrete portions.

Cavity 2030 further includes a front edge 2046 adjacent to the crown 2008 and/or sole 2006 nearest the front end 2010 of the club head 2000, and a rear edge 2048 adjacent to the crown 2008 and/or the sole 2006 nearest the rear end 2011 of the club head 2000. Further, the cavity 2030 includes a length extending from the heel portion 2002 to the toe portion 2004, an outer surface 2052, an inner surface 2054, and a thickness 2056 measured as the minimum distance between the outer surface 2052 and the inner surface 2054. In the illustrated examples of FIGS. 226 and 27, the thickness 2056 of cavity 2030 is substantially constant from near the front edge 2046 to near the rear edge 2048 of cavity 2030. Further, in the illustrated examples of FIGS. 26 and 27, the thickness 2056 of cavity 2030 is substantially constant from near the heel portion 2002 to near the toe portion 2004 of club head 2000. In other examples, the thickness 2056 of cavity 2030 can vary according to any profile from near the front edge 2046 to near the rear edge 2048 of club head 2000. Further, in other examples, the thickness 2056 of cavity 2030 can vary according to any profile from near the heel portion 2002 to near the toe portion 2004 of club head 2000.

Referring to FIGS. 26 and 27, cavity 2030 further includes a main portion 2038 and an inset portion 2036. The main portion 2038 of the cavity 2030 extends inward from the sole 2006 of club head 2000 between the front edge 2046 and the rear edge 2048. The inset portion 2036 extends from the main portion 2038 of cavity 2030 toward strikeface 2012. In many embodiments, the main portion 2038 and the inset portion 2036 are separated by a plane formed by a plurality of axes 2047 extending parallel to the loft plane 2064 and through the front edge 2046 at each location along the length of the cavity. In many embodiments, each location along the length of the cavity can be defined by increments of length of approximately 0.1 inch. In other embodiments, each location along the length of the cavity can be defined by increments of length less than 0.100 inch, less than 0.075 inch, or less than 0.050 inch.

The inset portion 2036 increases strikeface deflection on impact with a golf ball, compared to a club head having a cavity without an inset portion. Further, the inset portion 2036 distributes stresses to a greater extent on impact with a golf ball compared to a club head having a cavity without an inset portion. In many embodiments, greater dispersion of stresses in the golf club head due to inset portion 2036 prevents stress risers from occurring at the front edge 2046 or rear edge 2048 of the cavity 2030.

In many embodiments, cavity 2030 is offset from the loft plane 2064 or strikeface 2012 of the club head 2000. In some embodiments (FIG. 26), the front edge 2046 of the cavity 2030 can be offset from the loft plane 2064 or strikeface 2012 by a constant distance extending from near the heel region 2002 to near the toe region 2004. In other embodiments (not shown), front edge 2046 of the cavity 2030 can be offset from the loft plane 2064 or the strikeface 2012 by a varying distance extending from near the heel region 2002 to near the toe region 2004. For example, in other embodiments, the front edge 2046 of the cavity 2030 near the center of the strikeface 2012 can be positioned closer to the strikeface 2012 than the front edge 2046 of the cavity 2030 near the heel region 2002 and/or near the toe region 2004 of the club head 2000.

In many embodiments, at least a portion of the front edge 2046 of the cavity 2030 can be offset from the loft plane 2064 or strikeface 2012 by a distance 2049 less than or equal to 1.0 inch, measured in a direction perpendicular to the loft plane 2064. In other embodiments, at least a portion of the front edge 2046 of the cavity 2030 can be offset from the loft plane 2064 or the strikeface 2012 by a distance 2049 less than or equal to 0.75 inch, less than or equal to 0.50 inch, less than or equal to 0.45 inch, less than or equal to 0.40 inch, less than or equal to 0.35 inch, less than or equal to 0.30 inch, less than or equal to 0.25 inch, less than or equal to 0.20 inch, less than or equal to 0.15 inch, less than or equal to 0.10 inch, or less than or equal to 0.05 inch, measured in a direction perpendicular to the loft plane 2064. For example, in many embodiments, at least a portion of the front edge 2046 of the cavity 2030 is offset from the loft plane 2064 or the strikeface 2012 by a distance between 0.025-0.075 inch, measured in a direction perpendicular to the loft plane 2064.

In many embodiments, positioning at least a portion of the front edge 2046 of the cavity 2030 in close proximity to the strikeface can increase the internal energy stored by the club head 2000 during impact, thereby increasing the energy transfer to a golf ball, compared to a similar club head having a cavity with a front edge positioned farther from the strikeface. Increasing the energy transfer to a golf ball can result in increased ball speed and travel distance.

For example, in one embodiment, positioning at least a portion of the front edge 2046 of the cavity 2030 at an offset distance 2049 of 0.05 inch from the strikeface, measured in a direction perpendicular to the loft plane 2064, increased the internal energy stored by the club head 2000 by approximately 8.6 percent, compared to a club head devoid of a cavity. For further example, in one embodiment, positioning at least a portion of the front edge 2046 of the cavity 2030 at an offset distance 2049 of 0.10 inch from the strikeface, measured in a direction perpendicular to the loft plane 2064, increased the internal energy stored by the club head 2000 by approximately 2.9 percent, compared to a club head devoid of a cavity. In these examples, the club head having the cavity with the front edge positioned 0.05 inch from the strikeface 2012 stored approximately 5.6 percent more internal energy on impact with a golf ball compared to the club head having the cavity with the front edge positioned 0.10 inch from the strikeface 2012. Accordingly, positioning the front edge 2046 of the cavity 2030 closer to the strikeface 2012 can increase the internal energy stored by the club head 2000 on impact with a golf ball, resulting in increased energy transfer to the ball, increased ball speed, and increased travel distance.

Referring to FIGS. 26 and 27, the cavity 2030 can be further described with reference a front-to-rear cross-section. The front-to-rear cross-section is taken in a plane positioned perpendicular to the ground plane 2058 and the front plane 2060, extending from the front end 2010 toward the rear end 2011 of club head 2000. The front-to-rear cross-section can be position anywhere along the length of the cavity. For example, FIG. 26 illustrates a cross sectional view of the club head along a plane positioned at a midpoint of cavity 2030.

Referring to FIGS. 26 and 27, the cavity 2030 further includes an apex axis 2068 when cavity 2030 is positioned on the sole 2006. The apex axis 2068 is positioned at an offset distance 2076 from the front plane. The offset distance 2076 of the cavity 2030 can be constant, or the offset distance 2076 of the cavity 2030 can vary from the heel portion 2002 to the toe portion 2004 of the club head 2000.

The apex axis 2068 defines the deepest part of, or the maximum depth 2074 of cavity 2030 at each location along the length of the cavity 2030 extending from the heel portion 2002 to the toe portion 2004. The maximum depth 2074 of cavity 2030 positioned on the sole 2006 is measured from the front edge 2046 to the apex axis 2068 in a direction parallel to the loft plane 2064. The maximum depth 2074 of the cavity 2030 can be constant, or the maximum depth 2074 of the cavity 2030 can vary from the heel portion 2002 to the toe portion 2004 of the club head 2000. For example, the maximum depth 2074 of the cavity 2030 in a front-to-rear cross-section taken at the midpoint of the cavity 2030 can be different than the maximum depth 2074 of the cavity 2030 in a front-to-rear cross-section taken near the heel portion 2002 or near the toe portion 2004 of the club head 2000.

Referring to FIGS. 26 and 27, cavity 2030 further includes a front surface 2078 and a rear surface 2080. The front surface 2078 extends from the front edge 2046 to the apex axis 2068 of the cavity 2030. The rear surface 2080 extends from the apex axis 2068 to the rear edge 2048 of the cavity 2030. Accordingly, the front surface 2078 and rear surface 2080 are separated by the apex axis 2068 of the cavity 2030. Referring to FIGS. 26 and 27, at least a portion of front surface 2078 of cavity 2030 extends toward the strikeface 2012 in a direction from near the front edge 2046 toward the apex axis 2068. In these or other embodiments, at least a portion of the front surface 2078 of the cavity 2030 extends toward the strikeface 2012 to promote increased strikeface deflection and increased stress distribution across the cavity 2030 and club head body 2001. The front surface 2078 can have any profile such that at least a portion of the front surface profile extends toward the strikeface 2012 of club head 2000. In many embodiments, the portion of the front surface 2078 that extends toward the strikeface 2012 forms the inset portion of the cavity 2030.

The front surface 2078 further includes a forward most point 2082 and a rearward most point 2084 in any front-to-rear cross-section of the club head 2000. The forward most point 2082 is positioned along the front surface 2078 nearest the front plane 2060 or strikeface 2012, and the rearward most point 2084 is positioned along the front surface 2078 farthest from the front plane 2060 or strikeface 2012. The forward most point 2082 is positioned at a first distance D1 from the front plane 2060, and the rearward most point 2084 is positioned at a second distance D2 from the front plane 2060. The second distance D2 is greater than the first distance D1 in at least one front-to-rear cross-section of the cavity 2030. The first distance D1 and the second distance D2 can be constant, or the first distance D1 and the second distance D2 can vary from the heel portion 2002 to the toe portion 2004 of the club head 2000. For example, the first distance D1 of the cavity 2030 in a front-to-rear cross-section taken at the midpoint of the cavity 2030 can be different than the first distance D1 of the cavity 2030 in a front-to-rear cross-section taken near the heel portion 2002 or near the toe portion 2004 of the club head 2000. For further example, the second distance D2 of the cavity 2030 in a front-to-rear cross-section taken at the midpoint of the cavity 2030 can be different than the second distance D2 of the cavity 2030 in a front-to-rear cross-section taken near the heel portion 2002 or near the toe portion 2004 of the club head 2030. In many examples, a ratio of the second distance D2 to the first distance D1 is greater than 1.0, greater than 1.05, greater than 1.1, greater than 1.15, greater than 1.2, greater than 1.25, or greater than 1.3 in at least a portion of the cavity 2030.

Referring to FIGS. 26 and 27, an axis 2086 extends through the forward most point 2082 and the rearward most point 2084 of the front surface 2078 of the cavity 2030. In the illustrated embodiment, the axis 2086 intersects the strikeface 2012 of the club head 2000. In many embodiments, the axis 2086 intersects the strikeface 2012 of the club head 2000 at an acute angle. Further, the axis 2086 is positioned at an angle 2088 to the loft plane 2064 of the club head 2000. In many embodiments, the angle 2088 ranges from 0 to 90 degrees, from 5 to 85 degrees, from 10-80 degrees, or from 15 to 75 degrees, to increase strikeface deflection compared to a club head having a cavity with a front surface that does not extend toward the strikeface. The angle 2088 can be constant or the angle 2088 can vary from the heel portion 2002 to the toe portion 2004 of the club head 2000. For example, the angle 2088 of the cavity 2030 in a front-to-rear cross-section taken at the midpoint of the cavity 2030 can be different than the angle 2088 of the cavity 2030 in a front-to-rear cross-section taken near the heel portion 2002 or near the toe portion 2004 of the club head 2000.

In many embodiments, the inset portion 2036 of the cavity includes a height 2040 and a depth 2050. In the illustrated embodiment, height 2040 of inset portion 2036, measured parallel to the loft plane 2064, remains constant from heel portion 2002 to toe portion 2004 of the club head 2000. In the illustrated embodiment, the height 2040 of the cavity 2030 can vary from near the front end 2010 to near the rear end 2011 of the club head 2000. For example, in the illustrated embodiment, the height 2040 of the cavity 2030 increases from near the front end 2010 to near the rear end 2011 of the club head 2000. In other embodiments, the height 2040 of the cavity 2030 can vary according to any profile from near the front end 2010 to near the rear end 2011 of the club head 2000.

Further, the height 2040 of inset portion 2036 can increase or decrease according to any profile from heel portion 2002 to toe portion 2004 of the club head. For example, height 2040 of inset portion 2036 can increase from heel portion 2002 to toe portion 2004 of club head 2000. For further example, height 2040 of inset portion 2036 can decrease from heel portion 2002 to toe portion 2004 of club head 2000. For further example, height 2040 of inset portion 2036 can increase moving from the center of club head 2000 toward heel portion 2002 and toe portion 2004. For further example, height 2040 of inset portion 2036 can decrease moving from the center of club head 2000 toward heel portion 2002 and toe portion 2004.

In the illustrated embodiment, depth 2050 of inset portion 2036, measured as the distance between the front edge and the forward most point 2082 in a direction parallel to the loft plane 2064, remains constant from heel portion 2002 to toe portion 2004 of the club head 2000. In other embodiments, depth 2050 of inset portion 2036 can increase or decrease according to any profile from heel portion 2002 to toe portion 2004 of the club head 2000. For example, depth 2050 of inset portion 2036 can increase from heel portion 2002 to toe portion 2004 of club head 2000. For further example, depth 2050 of inset portion 2036 can decrease from heel portion 2002 to toe portion 2004 of club head 2000. For further example, depth 2050 of inset portion 2036 can increase moving from the center of club head 2000 toward heel portion 2002 and toe portion 2004. For further example, depth 2050 of inset portion 2036 can decrease moving from the center of club head 2000 toward heel portion 2002 and toe portion 2004.

In the illustrated embodiment of FIGS. 26 and 27, the profile of the front surface 2078 is unidirectional. Further, front surface 2078 extends toward the apex axis 2068 of cavity 2030 in a direction toward the strikeface 2012. In these or other examples, the forward most point 2082 of front surface 2078 is positioned near apex axis 2068 of cavity 2030 and the rearward most point 2084 is positioned near front edge 2046 of cavity 2030. In other embodiments, the front surface profile can be multidirectional and can have any profile such that at least a portion of the front surface extends toward the apex axis of the cavity in a direction toward the strikeface 2012.

In the illustrated embodiment of FIGS. 26 and 27, the rear surface 2080 of the cavity 2030 is substantially straight. In other embodiments, the rear surface 2080 of the cavity 2030 can have any shape.

In other examples, cavity 2030 can be oriented such that main portion 2038 of cavity 2030 extends inward from the sole 2006 of the club head 2000 and inset portion 2036 extends from the main portion 2038 of the cavity 2030 toward the rear end 2011 of the club head 2000. In these examples, front surface 2078 can have any profile, and at least a portion or rear surface 2080 can extend toward rear end 2011 of club head 2000.

Figure 22:
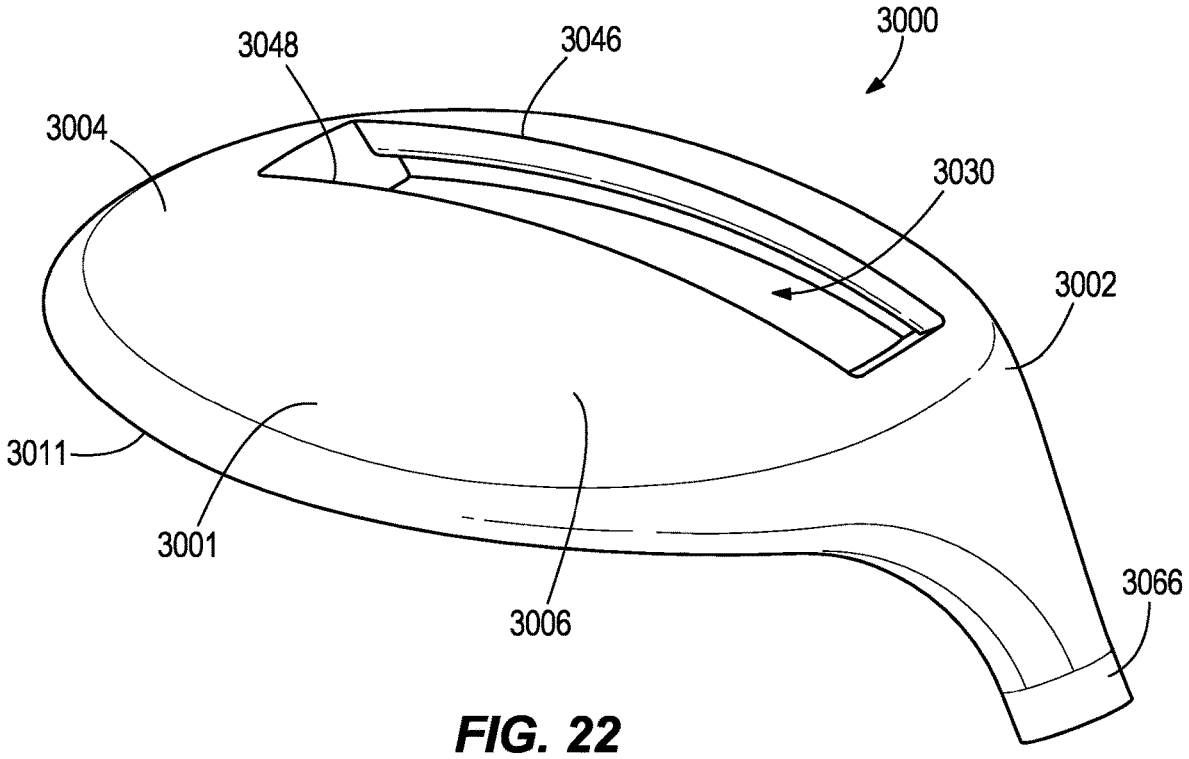
FIG. 22 depicts a rear perspective view of an exemplary golf club head according to another embodiment.
Figure 23:
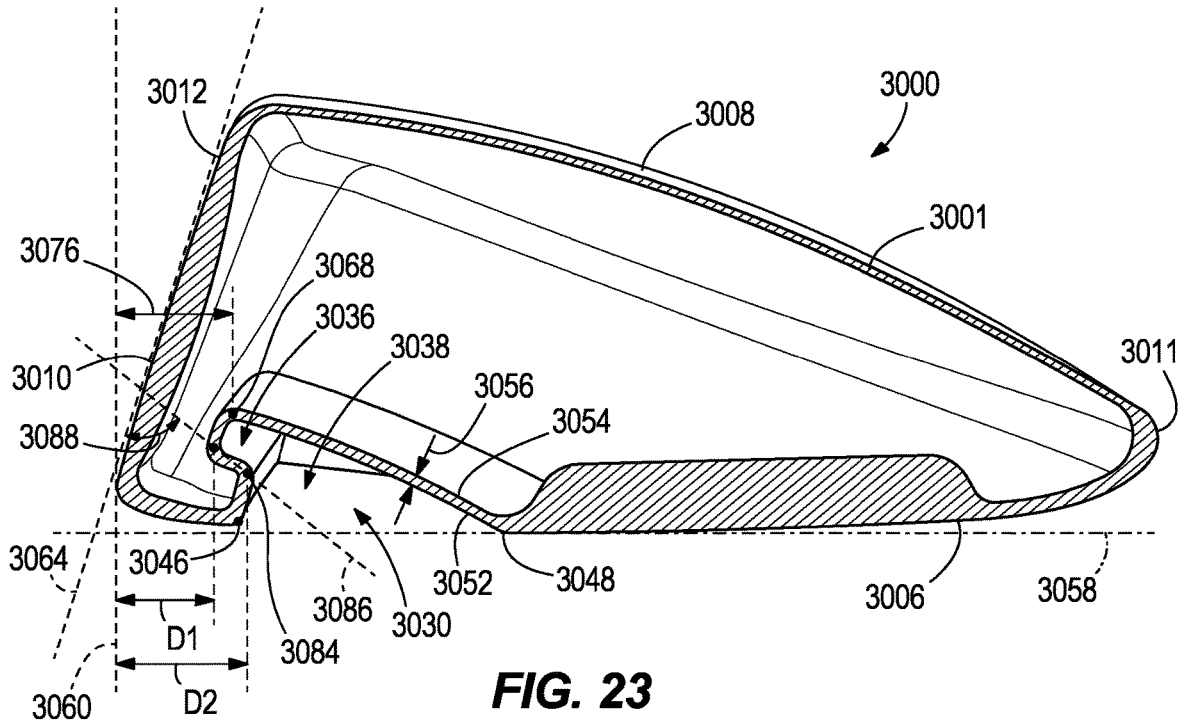
FIG. 23 depicts a cross-sectional view of the exemplary golf club head of FIG. 22.
Figure 23A:
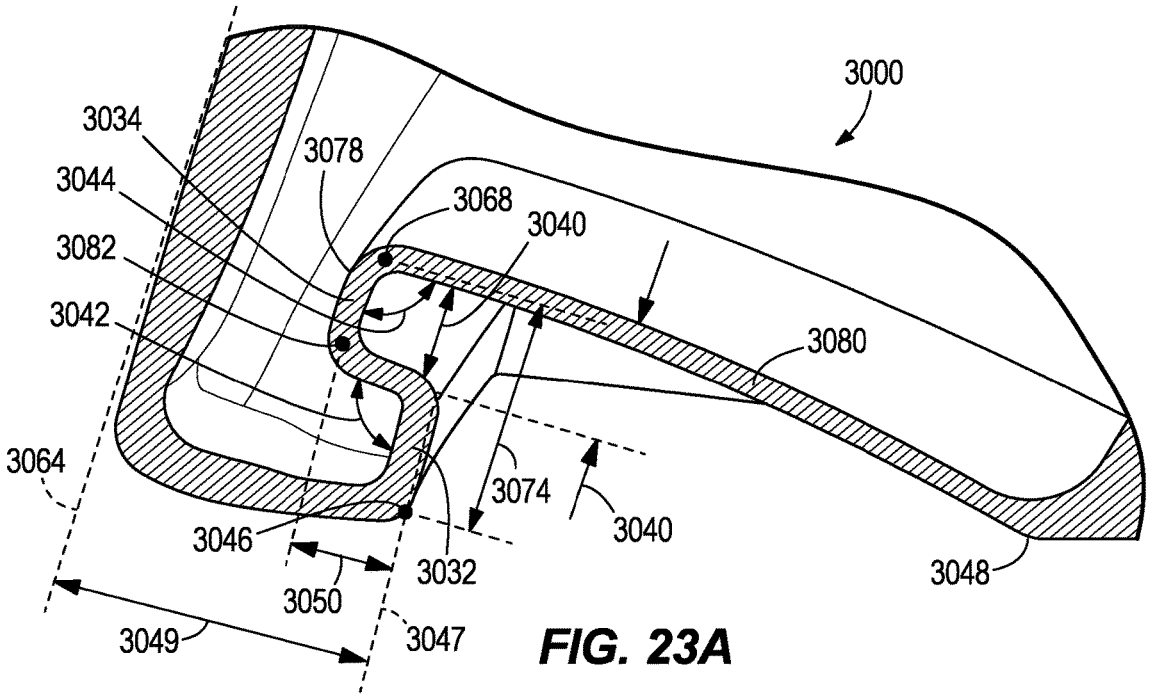
FIG. 23A depicts an enlarged view of a portion the cross-sectional view of the exemplary golf club head of FIG. 23.

FIGS. 22 and 23 illustrate another embodiment of a club head 3000 having a strikeface 3012 and a body 3001 having a heel region 3002, a toe region 3004 opposite heel region 3002, a sole 3006, a crown 3008 opposite sole 3006, a front end 3010, a rear end 3011 opposite front end 3010, and a cavity 3030. Club head 3000 can be similar to club head 2000 with like numbers referencing similar features, except the front surface 3078 of the cavity 3030 is multi-directional. In these or other embodiments, the front surface 3078 extends from the front edge 3046 to the apex axis 3068 of cavity 3030 in multiple directions, such that at least a portion of front surface 3078 extends toward the strikeface 3012.

Referring to FIGS. 22-25, 28, and 29, in these or other examples, cavity 3030 includes the inset portion 3036, and can further include a side wall 3032 extending into the cavity 3030 from the front edge 3046, and an inner wall 3034 extending into the cavity 3030 from the rear edge 3048. Inset portion 3036 is positioned at a first angle 3042 to side wall 3032 and at a second angle 3044 to inner wall 3034. In the illustrated embodiments, the first angle 3042 is approximately 90 degrees. In other embodiments, the first angle 3042 can range from approximately 85-95 degrees, approximately 80-100 degrees, or approximately 75-105 degrees. Further, in the illustrated embodiments, the second angle 3044 is approximately 90 degrees. In other embodiments, the second angle 3044 can range from approximately 85-95 degrees, approximately 80-100 degrees, or approximately 75-105 degrees.

In these embodiments, the cavity 3030 of club head 3000 comprises the main portion 3038, the inset portion 3036, the front edge 3046, and the rear edge 3048, similar to the main portion 2038, the inset portion 2036, the front edge 2046, and the rear edge 2048, of the cavity 2030 of club head 2000, respectively. Further, the cavity 3030 of club head 3000 comprises the apex axis 3068, the front surface 3078, and the rear surface 3080 similar to the apex axis 2068, the front surface 2078, and the rear surface 2080 of the cavity 2030 of club head 2000, respectively. Accordingly, at least a portion of the front surface 3078 of club head 3000 extends toward the strikeface 3012.

FIG. 24 illustrates another embodiment of a club head 4000 having a strikeface 4012 and a body 4001 having a heel region 4002, a toe region 4004 opposite heel region 4002, a sole 4006, a crown 4008 opposite sole 4006, a front end 4010, a rear end 4011 opposite front end 4010, and a cavity 4030. Club head 4000 can be similar to club head 3000 with like numbers referencing similar features, except the cavity 4030 is positioned behind the strikeface 4012 and on the crown 4008 of the club head 4000. In these or other embodiments, cavity 4030 can increase strikeface deflection on impact with a golf ball, reduce backspin, and/or increase launch angle, resulting in increased ball speed and travel distance. Further, in these or other embodiments, positioning of the cavity 4030 at least partially on the crown can further increase strikeface bending for impacts low on the strikeface.

Referring to FIG. 24, the cavity 4030 further includes a nadir axis 4072 when cavity 4030 is positioned on the crown 4008. The nadir axis 4072 is positioned at an offset distance 4076 from the front plane. The offset distance 4076 of the cavity 4030 can be constant, or the offset distance 4076 of the cavity 4030 can vary from the heel portion 4002 to the toe portion 4004 of the club head 4000.

The nadir axis 4072 defines the deepest part of, or the maximum depth 4074 of cavity 4030 at each location along the length of the cavity 4030 extending from the heel portion 4002 to the toe portion 4004. The maximum depth 4074 of cavity 4030 positioned on the crown 4008 is measured from the front edge 4046 to the nadir axis 4072 in a direction parallel to the loft plane 4064. The maximum depth 4074 of the cavity 4030 can be constant, or the maximum depth 4074 of the cavity 4030 can vary from the heel portion 4002 to the toe portion 4004 of the club head 4000. For example, the maximum depth 4074 of the cavity 4030 in a front-to-rear cross-section taken at the midpoint of the cavity 4030 can be different than the maximum depth 4074 of the cavity 4030 in a front-to-rear cross-section taken near the heel portion 4002 or near the toe portion 4004 of the club head 4000.

Referring to FIG. 24, cavity 4030 further includes a front surface 4078 and a rear surface 4080. The front surface 4078 extends from the front edge 4046 to the nadir axis 4072 of the cavity 4030. The rear surface 4080 extends from the nadir axis 4072 to the rear edge 4048 of the cavity 4030. Accordingly, the front surface 4078 and rear surface 4080 are separated by the nadir axis 4072 of the cavity 4030. Referring to FIG. 24, at least a portion of front surface 4078 of cavity 4030 extends toward the strikeface 4012 in a direction from near the front edge 4046 toward the nadir axis 4072. In these or other embodiments, at least a portion of the front surface 4078 of the cavity 4030 extends toward the strikeface 4012 to promote increased strikeface deflection and increased stress distribution across the cavity 4030 and club head body 4001. The front surface 4078 can have any profile such that at least a portion of the front surface profile extends toward the strikeface 4012 of club head 4000. In many embodiments, the portion of the front surface 4078 that extends toward the strikeface 4012 forms the inset portion of the cavity 4030.

Referring to FIG. 24, cavity 4030 further includes a main portion 4038 and an inset portion 4036. The main portion 4038 of the cavity 4030 extends inward from the crown 4008 of club head 4000 between the front edge 4046 and the rear edge 4048. The inset portion 4036 extends from the main portion 4038 of cavity 4030 toward strikeface 4012. In many embodiments, the main portion 4038 and the inset portion 4036 are separated by a plane formed by a plurality of axes 4047 extending parallel to the loft plane 4064 and through the front edge 4046 at each location along the length of the cavity 4000. In many embodiments, each location along the length of the cavity can be defined by increments of length of approximately 0.1 inch. In other embodiments, each location along the length of the cavity can be defined by increments of length less than 0.100 inch, less than 0.075 inch, or less than 0.050 inch.

The inset portion 4036 increases strikeface deflection on impact with a golf ball, compared to a club head having a cavity without an inset portion. Further, the inset portion 4036 distributes stresses to a greater extent on impact with a golf ball compared to a club head having a cavity without an inset portion. In many embodiments, greater dispersion of stresses in the golf club head due to inset portion 4036 prevents stress risers from occurring at the front edge 4046 or rear edge 4048 of the cavity 4030.

Figure 30:
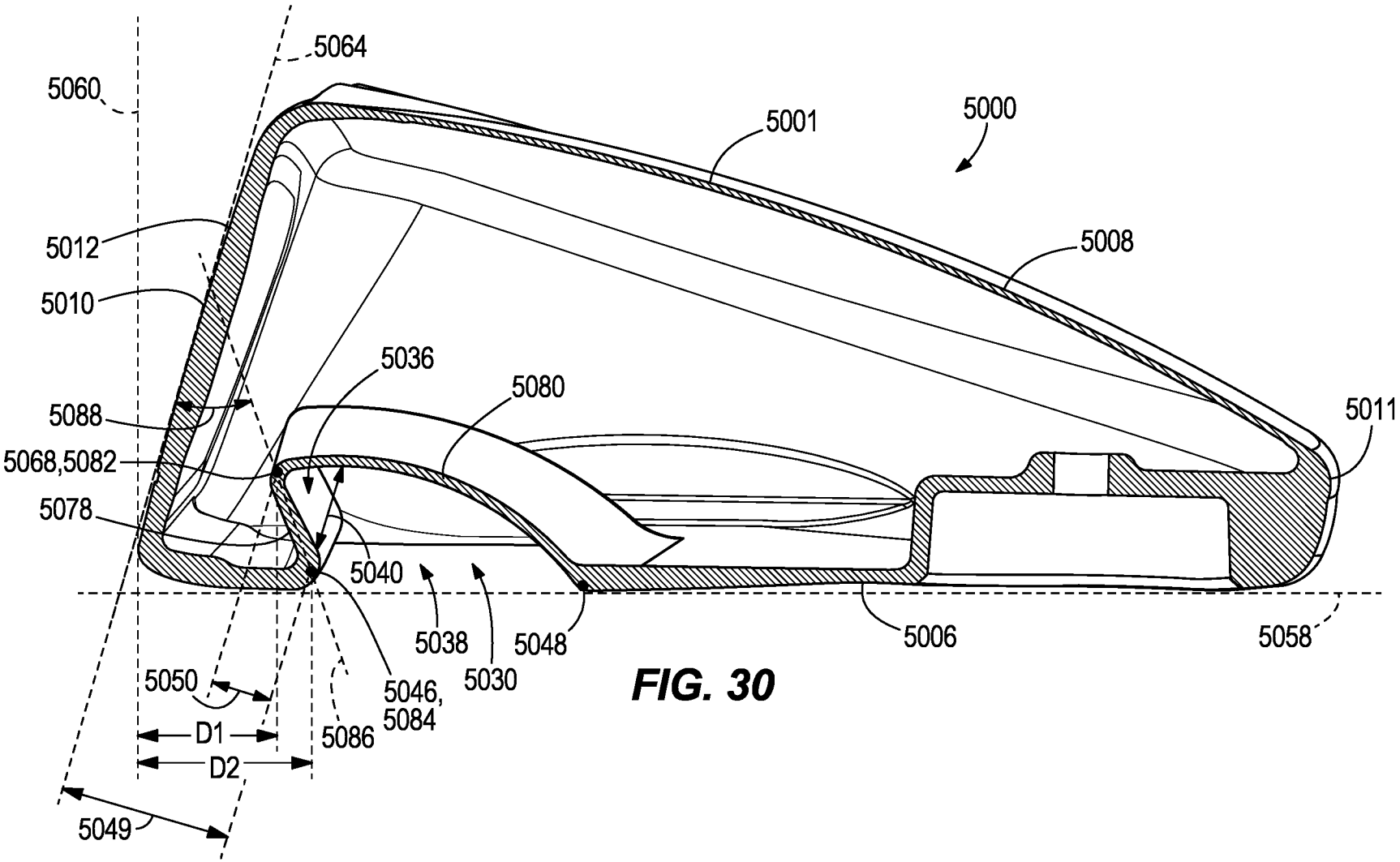
FIG. 30 depicts a cross-sectional view of another exemplary golf club head.

FIG. 30 illustrates another embodiment of a club head 5000 having a strikeface 5012 and a body 5001 having a heel region 5002, a toe region 5004 opposite heel region 5002, a sole 5006, a crown 5008 opposite sole 5006, a front end 5010, a rear end 5011 opposite front end 5010, and a cavity 5030. Club head 5000 can be similar to club head 2000 with like numbers referencing similar features, except the rear surface 5080 of the cavity 5030 is concave thereby conforming to the deformation of the club head on impact with a golf ball and allowing increased deflection and energy storage. In other embodiments, the cavity 5030 can have any other curved shape. For example, in other embodiments, the rear surface 5080 of the cavity 5030 can be convex, or can have any other profile.

In these embodiments, the cavity 5030 of club head 5000 comprises the main portion 5038, the inset portion 5036, the front edge 5046, and the rear edge 5048, similar to the main portion 2038, the inset portion 2036, the front edge 2046, and the rear edge 2048, of the cavity 2030 of club head 2000, respectively. Further, the cavity 5030 of club head 5000 comprises the apex axis 5068, the front surface 5078, and the rear surface 5080 similar to the apex axis 2068, the front surface 2078, and the rear surface 2080 of the cavity 2030 of club head 2000, respectively. Accordingly, at least a portion of the front surface 5078 of club head 5000 extends toward the strikeface 5012.

Figure 28:
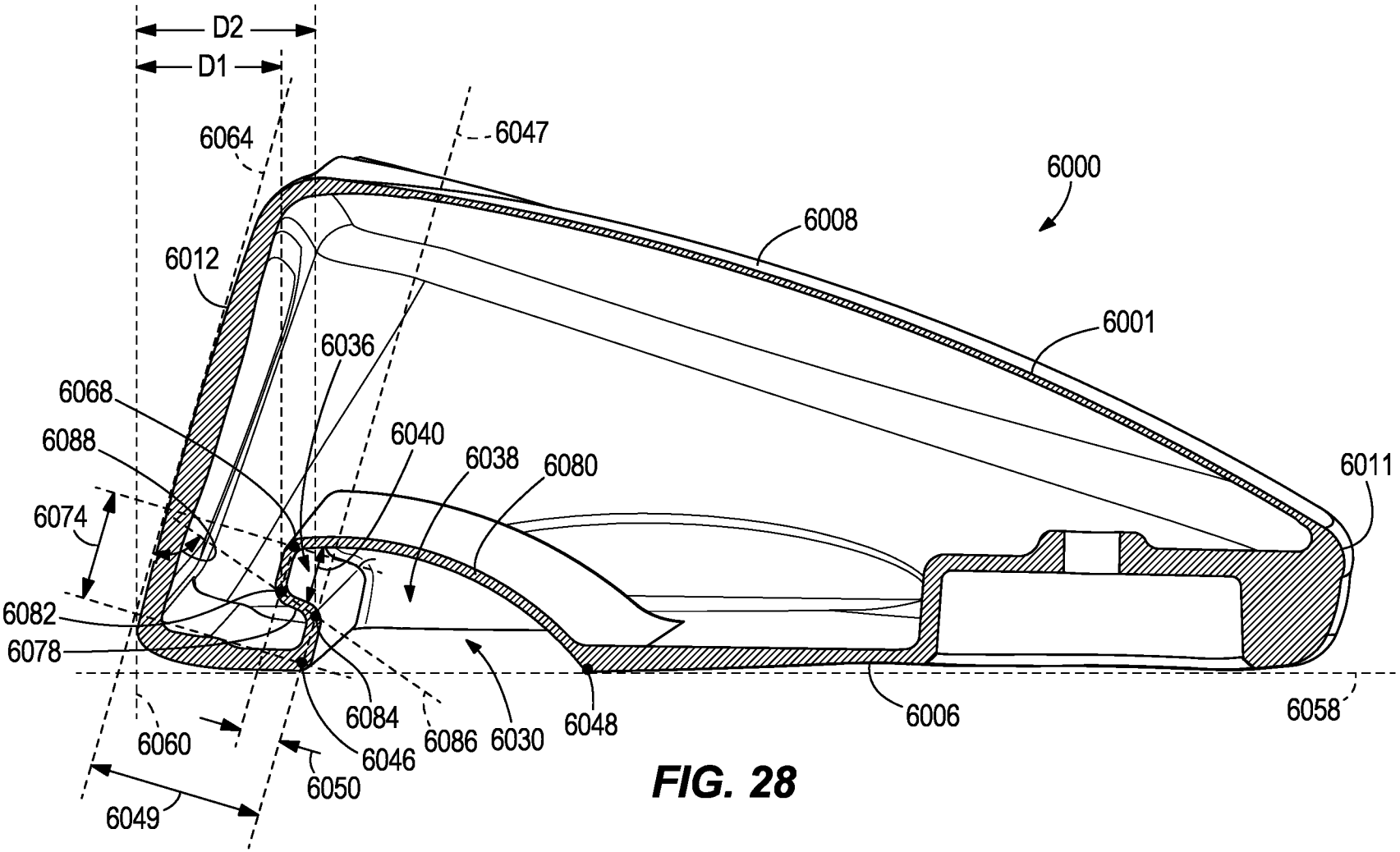
FIG. 28 depicts a cross-sectional view of another exemplary golf club head.

FIG. 28 illustrates another embodiment of a club head 6000 having a strikeface 6012 and a body 6001 having a heel region 6002, a toe region 6004 opposite heel region 6002, a sole 6006, a crown 6008 opposite sole 6006, a front end 6010, a rear end 6011 opposite front end 6010, and a cavity 6030. Club head 6000 can be similar to club head 3000 with like numbers referencing similar features, except the rear surface 6080 of the cavity 6030 is concave, thereby conforming to the deformation of the club head on impact with a golf ball and allowing increased deflection and energy storage. In other embodiments, the cavity 6030 can have any other curved shape. For example, in other embodiments, the rear surface 6080 of the cavity 6030 can be convex, or can have any other profile.

In these embodiments, the cavity 6030 of club head 6000 comprises the main portion 6038, the inset portion 6036, the front edge 6046, and the rear edge 6048, similar to the main portion 3038, the inset portion 3036, the front edge 3046, and the rear edge 3048, of the cavity 3030 of club head 3000, respectively. Further, the cavity 6030 of club head 6000 comprises the apex axis 6068, the front surface 6078, and the rear surface 6080 similar to the apex axis 3068, the front surface 3078, and the rear surface 3080 of the cavity 3030 of club head 3000, respectively. Accordingly, at least a portion of the front surface 6078 of club head 6000 extends toward the strikeface 6012.

Figure 29:
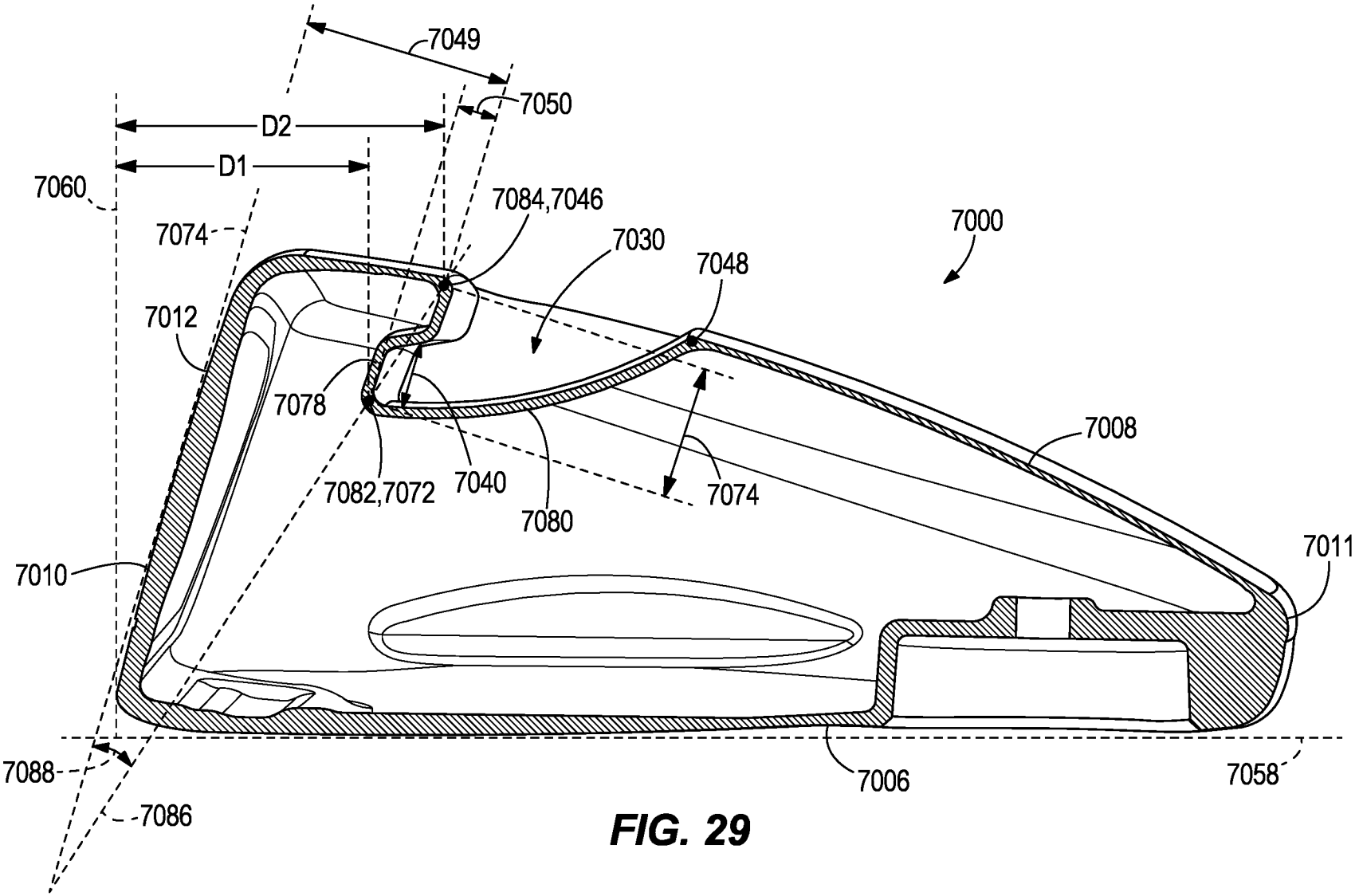
FIG. 29 depicts a cross sectional view of another exemplary golf club head.

FIG. 29 illustrates another embodiment of a club head 7000 having a strikeface 7012 and a body 7001 having a heel region 7002, a toe region 7004 opposite heel region 7002, a sole 7006, a crown 7008 opposite sole 7006, a front end 7010, a rear end 7011 opposite front end 7010, and a cavity 7030. Club head 7000 can be similar to club head 4000 with like numbers referencing similar features, except the rear surface 7080 of the cavity 7030 is concave, thereby conforming to the deformation of the club head on impact with a golf ball and allowing increased deflection and energy storage. In other embodiments, the cavity 7030 can have any other curved shape. For example, in other embodiments, the rear surface 7080 of the cavity 7030 can be convex, or can have any other profile.

In these embodiments, the cavity 7030 of club head 7000 comprises the main portion 7038, the inset portion 7036, the front edge 7046, and the rear edge 7048, similar to the main portion 4038, the inset portion 4036, the front edge 4046, and the rear edge 4048, of the cavity 4030 of club head 4000, respectively. Further, the cavity 7030 of club head 7000 comprises the nadir axis 7072, the front surface 7078, and the rear surface 7080 similar to the nadir axis 4072, the front surface 4078, and the rear surface 4080 of the cavity 4030 of club head 4000, respectively. Accordingly, at least a portion of the front surface 7078 of club head 7000 extends toward the strikeface 7012.

FIG. 25 illustrates another embodiment of a club head 8000 having a strikeface 8012 and a body 8001 having a heel region 8002, a toe region 8004 opposite heel region 8002, a sole 8006, a crown 8008 opposite sole 8006, a front end 8010, a rear end 8011 opposite front end 8010, and a cavity 8030. Club head 8000 can be similar to club head 4000 with like numbers referencing similar features, except the cavity 8030 of club head 8000 is positioned at a transition between the strikeface 8012 and the crown 8008. In these or other embodiments, the inset portion 8036 can be located closer to the rear end 8011 of the club head 8000 than the main portion 8038 of the cavity 8030.

In other embodiments, the cavity 8030 can be positioned on any transition region between the strikeface 8012 and the body 8001 of the club head 8000. For example, in other embodiments, the cavity 8030 can be positioned at a transition between the strikeface 8012 and the sole 8006.

Referring to FIGS. 22-30, the club heads 2000, 3000, 4000, 5000, 6000, 7000, 8000 having the cavity 2030, 3030, 4030, 5030, 6030, 7030, 8030 described herein can store increased internal energy on impact with a golf ball. Increased stored energy allows increased energy to be transferred to the golf ball on impact, thereby increasing ball speed and travel distance, compared to a similar club head devoid of the cavity or compared to a similar club head having a cavity devoid of a cavity with an inset portion.

For example in some embodiments, the club head having the cavity described herein stored approximately 48-90% more internal energy on simulated impact with a golf ball at a swing speed of 100 miles per hour, compared to a similar club head devoid of a cavity. For further example, referring to Table 1, the club head 6000 illustrated in FIG. 28, stored 4.0% more internal energy on simulated impact with a golf ball at a swing speed of 100 miles per hour, compared to a similar club head having a similar cavity without an inset portion. For further example, referring to Table 1, the club head 5000 illustrated in FIG. 30 can store approximately 4-10% more internal energy on simulated impact with a golf ball at a swing speed of 100 miles per hour, compared to a similar club head having a similar cavity without an inset portion.

Further referring to FIGS. 22-30 the club heads 2000, 3000, 4000, 5000, 6000, 7000, 8000 having the cavity 2030, 3030, 4030, 5030, 6030, 7030, 8030 described herein can redistribute impact stress over a greater surface area, thereby increasing the durability of the club head compared to a similar club head devoid of a cavity or devoid of a cavity having an inset portion. Many club head devoid of a cavity having an inset portion experience high stress near the front edge of the cavity. To the contrary, the club heads 2000, 3000, 4000, 5000, 6000, 7000, 8000 having the cavity 2030, 3030, 4030, 5030, 6030, 7030, 8030 described herein allow increased torosional bending of the club head and/or cavity on impact, thereby allowing the impact stresses to be distributed across a greater area of the cavity to reduce stress risers at the front and rear edges and increase club head durability.

For example, referring to Table 1, the club heads 6000 and 5000 illustrated in FIGS. 28 and 30 experienced a peak stress on impact between 17-25% less than the peak stress of a similar club head having a similar cavity without an inset portion on simulated impact with a golf ball at a swing speed of 100 miles per hour.

TABLE 1

Increase in internal energy storage and reduction in peak stress of the club head having an inset portion compared to a similar club head having a similar cavity devoid of an inset portion

| Club Head | Percent Increase in Internal Energy Storage on Simulated Impact at 100 miles per hour | Percent Reduction in Peak Stress on Simulated Impact at 100 miles per hour |
|---|---|---|
| 5000, FIG. 30 | 4.0% | 17-25% |
| 6000, FIG. 28 | 4-10% | 17-25% |

III. Golf Club Head with Cascading Sole and Back Cavity

Figure 14:
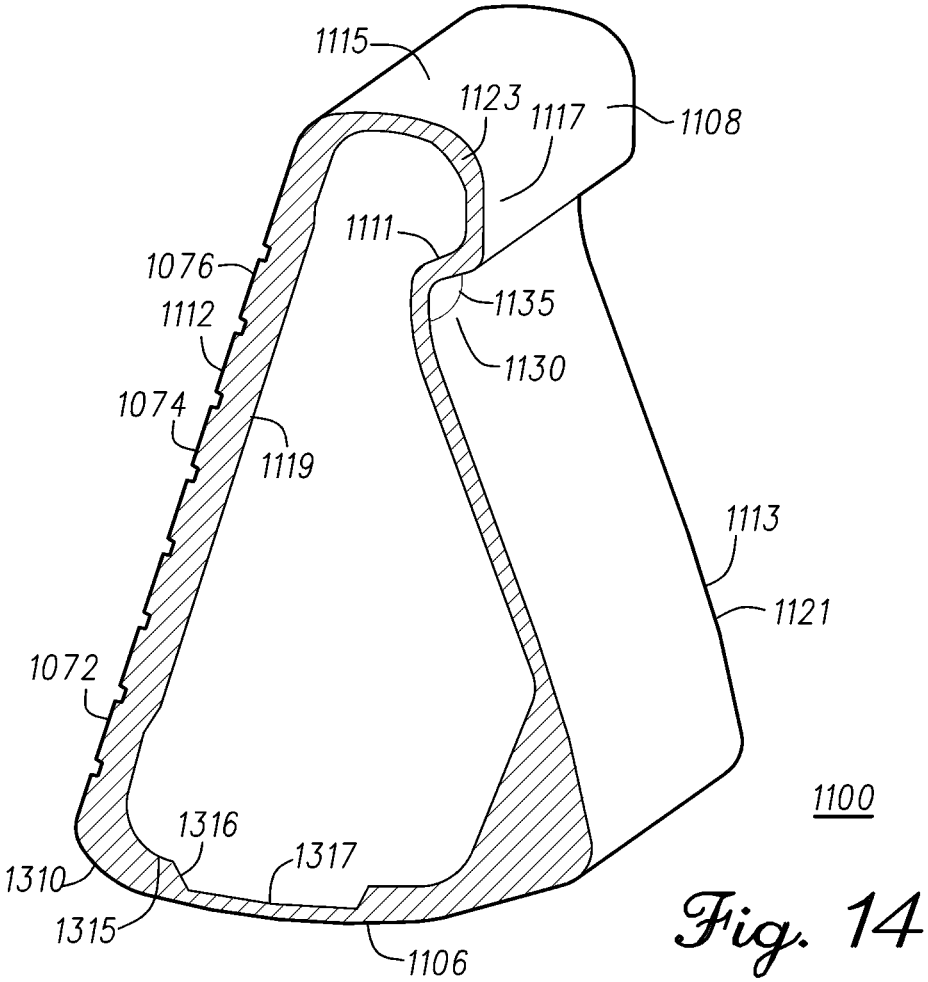
FIG. 14 depicts a cross-section view of a golf club head, similar to the golf club head of FIG. 10, along a cross-sectional line similar to cross-sectional line XII-XII of FIG. 10, according to another embodiment.

In some embodiments, a golf club head with a back cavity can further comprise a cascading sole with tiered thin sections. FIG. 14 illustrates a cross-section of golf club head 1100, which can be similar to golf club head 1000 (FIG. 10), along a similar cross-sectional line XII-XII in FIG. 10, according to an embodiment. Similar to golf club head 1000 (FIG. 10), golf club head 1100 comprises a body 1101. Body 1101 comprises a strikeface 1112, a sole 1106, and a crown 1108. Strikeface 1112 comprises a high region 1176, a middle region 1174, and a low region 1172. Crown 1108 comprises an upper region 1111 and a lower region 1113. Upper region 1111 comprises a top rail 1115. In many embodiments, a cavity 1130 is located below top rail 1115. Golf club head 1100 further comprises a cascading sole 1310, similar to internal radius transition 310 (FIG. 3). Internal radius transition 1310 comprises a first tier 1315 at a first thickness, a second tier 1317 at a second thickness, and a tier transition region 1316. In some embodiments, cascading sole 1310 can provide further pliability to top rail 1115. In many embodiments, the back cavity combined with the cascading sole can provide an even greater spring effect on the strikeface. In some embodiments, the back cavity with the cascading sole allows approximately 3%-5% more energy in the deflection of the strikeface. The cascading sole 1310 can include any number of tiers greater than or equal to two tiers. For example, the cascading sole 1310 can have 2, 3, 4, 5, 6, or 7 tiers.

The golf club head 1100 having the cascading sole and the back cavity can provide a greater recoiling force to the strikeface than the golf club head having the cascading sole or back cavity alone. This is due to the combined increased recoiling force from both the internal radius transition and the back cavity, as discussed above. The increased recoiling force to the strikeface leads to greater deflection, which in turn increases the impact force applied to the golf ball thereby increasing the speed of the golf ball. In some embodiments, golf club head 1100 comprising both cavity 1130 and internal radius transition 1310 can increase ball speed, increase launch angle, and provide better distance control. In various embodiments, golf club head 1100 can increase ball speeds approximately 1% to approximately 4%. In some embodiments, golf club head 1100 can increase ball speeds approximately 1%, 2%, 3%, or 4%. In many embodiments, golf club head 1100 provides a larger increase in ball speeds when the golf ball impacts the strikeface in high region 1176. In some embodiments, golf club head 1100 can increase the launch angle by approximately 0.5 degrees to approximately 1.1 degrees. In some embodiments, golf club head 1100 can increase the launch angle by approximately 0.5 degrees, 0.6 degrees, 0.7 degrees, 0.8 degrees, 0.9 degrees, 1.0 degrees, or 1.1 degrees.

Figure 19:
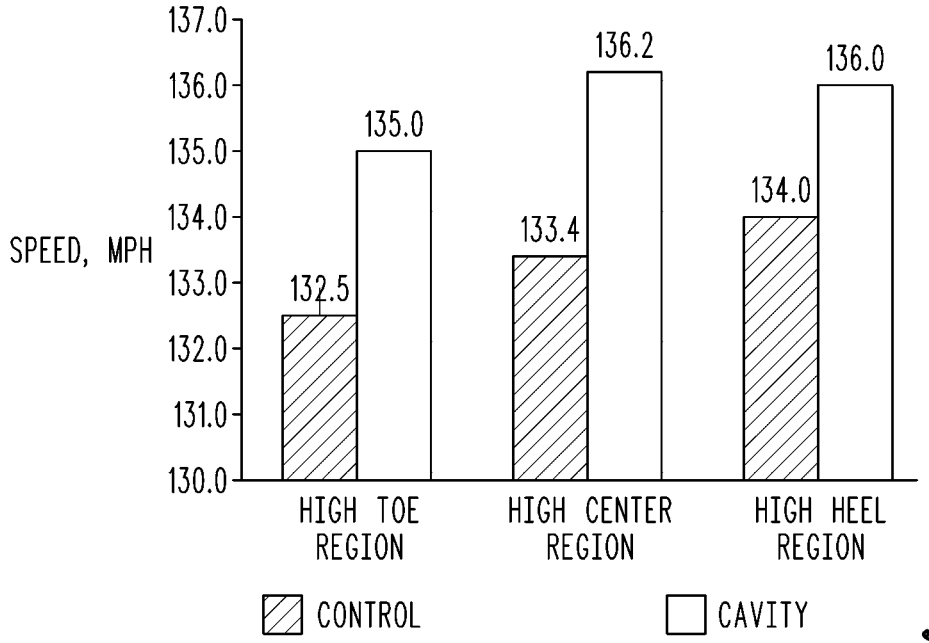
FIG. 19 depicts results from testing of the golf club head of FIG. 14, according to another embodiment.
Figure 20:
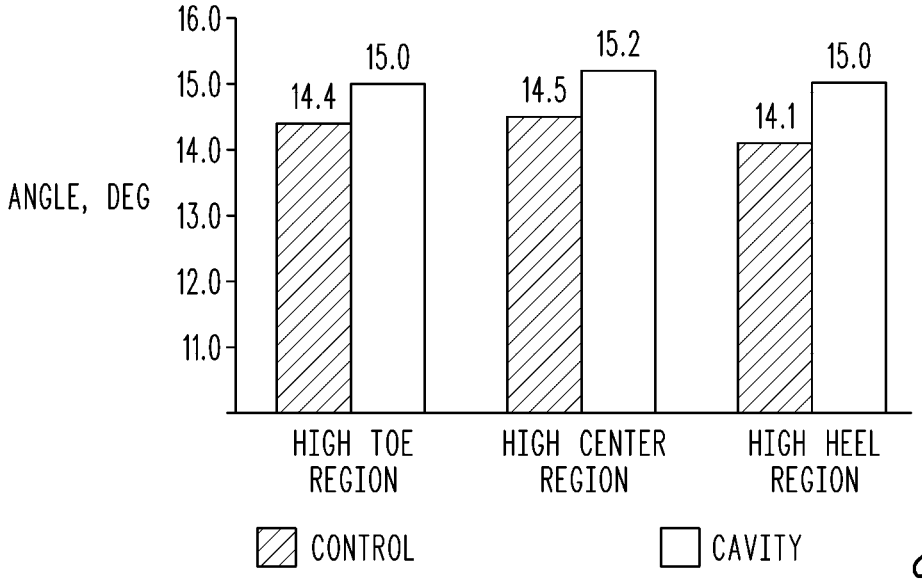
FIG. 20 depicts results from testing of the golf club head of FIG. 14, according to another embodiment.

An embodiment of golf club head 1100 having the cascading sole and the back cavity was tested. Overall, when compared to a control golf club head devoid of the cascading sole and the back cavity, the cavity golf club head showed an increase in golf ball speed and an increase in launch angle. The cavity golf club head showed the increase in golf ball speed and the increase in launch angle for all contact positions on the face due to the combined spring effect from the combination of cascading sole 1310 (FIG. 14) and cavity 1130 (FIG. 14). In some embodiments, a greater increase in golf ball speed and launch angle was observed on contact with high portions of the face, (e.g., high region 1076 (FIG. 12) or high region 1176 (FIG. 14)) due in part from the spring effect of cavity 1130 (FIG. 14). FIGS. 19-20 depicts results from the testing of the embodiment of golf club head 1100 (cavity golf club head) compared to a standard iron-type golf club head (control golf club head) with a closed back design and similar loft angle as the cavity golf club head. FIG. 19 shows an increase in golf ball speed in the cavity golf club head compared to the control golf club head when the golf ball impacts the high region of the strikeface, and FIG. 20 shows an increase in launch angle of the cavity golf club head compared to the control golf club head when the golf ball impacts the high region of the strikeface.

Specifically, FIG. 19 shows that golf ball speed is increased by approximately 1.9% (or approximately 2.5 mph) for the cavity golf club head when the golf ball impacts a high-toe region of the strikeface, approximately 2.1% (or approximately 2.8 mph, or approximately 4.5 kph) when the golf ball impacts a high-center region of the strikeface, and approximately 1.5% (or approximately 2.0 mph, or approximately 3.2 kph) when the golf ball impacts a high-heel region of the strikeface (all of the cavity golf club head), when compared to the control golf club head. When the golf ball impacts the strikeface in the high-toe region of the control golf club head, the golf ball speed is approximately 132.5 mph (213.2 kph), while the golf ball reaches approximately 135.0 mph (217.3 kph) when it impacts the strikeface in the high-toe region of the cavity golf club head. When the golf ball impacts the strikeface in the high-center region of the control golf club head, the golf ball speed is approximately 133.4 mph (214.7 kph), while the golf ball reaches approximately 136.2 mph (219.2 kph) when it impacts the strikeface in the high-center region of the cavity golf club head. When the golf ball impacts the strikeface in the high-heel region of the control golf club head, the golf ball speed is approximately 134.0 mph (215.7 kph), while the golf ball reaches approximately 136.0 mph (218.9 kph) when it impacts the strikeface in the high-heel region of the cavity golf club head.

FIG. 20 shows that launch angle of the cavity golf club head is increased by approximately 4.2% (or approximately 0.6 degrees) when the golf ball impacts the high-toe region of the strikeface, approximately 4.8% (or approximately 0.7 degrees) when the golf ball impacts the high-center region of the strikeface, and approximately 6.4% (or approximately 0.9 degrees) when the golf ball impacts the high-heel region of the strikeface (all of the cavity golf club head), when compared with the control golf club head. When the golf ball impacts the strikeface in the high-toe region of the control golf club head, the launch angle is approximately 14.4 degrees, while the launch angle is approximately 15.0 degrees when it impacts the strikeface in the high-toe region of the cavity golf club head. When the golf ball impacts the strikeface in the high-center region of the control golf club head, the launch angle is approximately 14.5 degrees, while the launch angle is approximately 15.2 degrees when it impacts the strikeface in the high-center region of the cavity golf club head. When the golf ball impacts the strikeface in the high-heel region of the control golf club head, the launch angle is approximately 14.1 degrees, while the launch angle is approximately 15.0 degrees when it impacts the strikeface in the high-heel region of the cavity golf club head.

Figure 17:
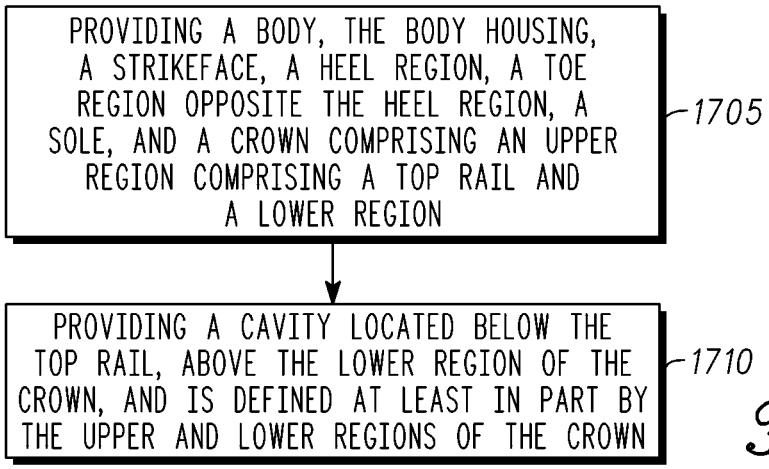
FIG. 17 depicts a flow diagram illustrating a method of manufacturing a golf club head according to an embodiment of another method.

FIG. 17 illustrates method 1700 for manufacturing a golf club head. Method 1700 comprises providing a body (block 1705). Providing a body in block 1705 comprises the body having a strikeface, a heel region, a toe region opposite the heel region, a sole, and a crown. In many embodiments, the crown comprises an upper region and a lower region. In some embodiments, the upper region comprises a top rail. In many embodiments, a cavity is located below the top rail and is located above the lower region of the crown (block 1710). In some embodiments, the cavity is defined at least in part by the upper and lower regions of the crown. The cavity comprises a top wall, a back wall adjacent to the top wall, a bottom incline adjacent to the back wall, a back cavity angle measured between the top and back walls of the cavity, and at least one channel.

In some embodiments, method 1700 further comprises providing an insert at the lower region of the crown towards the toe region. In some embodiments, the insert is similar to insert 1062 (FIG. 10).

In some embodiments, providing the body in block 1705 further comprises the body having a cascading sole. The cascading sole comprises an internal radius transition region from the strikeface to the sole. In many embodiments, the internal radius transition region can be similar to internal transition region or cascading sole 1310 (FIG. 14). In some embodiments, the internal transition region comprises a first tier comprising a first thickness, a second tier comprising a second thickness smaller than the first thickness, and a tier transition region between the first tier and the second tier.

IV. Golf Club with Cascading Sole and Back Cavity

Figure 15:
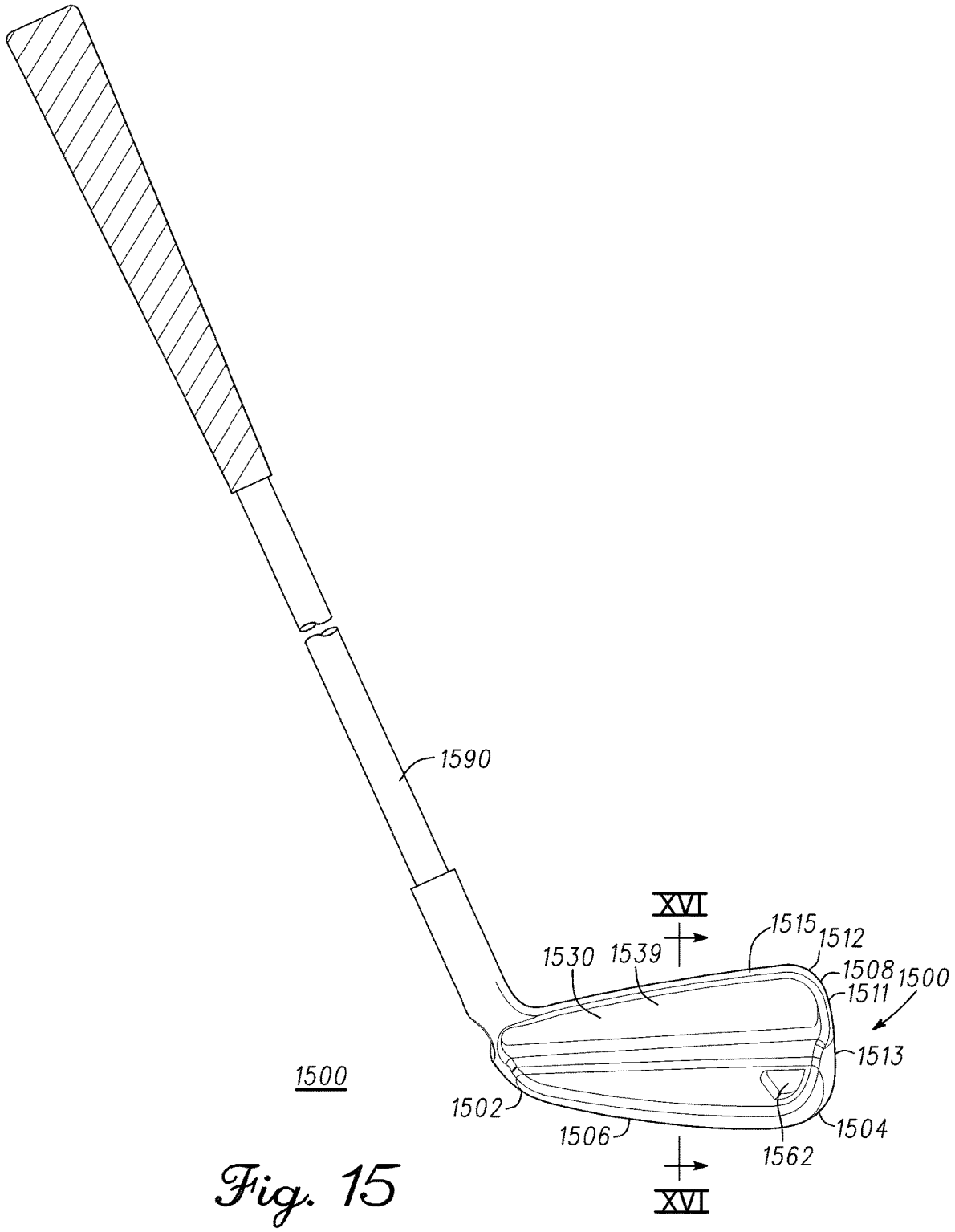
FIG. 15 depicts a back, toe-side perspective view of a golf club according to another embodiment.

Turning to FIG. 15, FIG. 15 illustrates a golf club 1500 comprising a golf club head 1500 and a shaft 1590 coupled to golf club head 1500. In some embodiments, golf club head 1500 of golf club 15000 comprises a hybrid-type golf club head. In other embodiments, golf club head 1500 can be an iron-type golf club head or a fairway wood-type golf club head. In many embodiments, golf club head 1500 can be similar to golf club head 100 or golf club head 1000 (FIG. 10). Golf club head 1500 can be hollow-bodied and comprises a strikeface 1512, a heel region 1502, a toe region 1504 opposite heel region 1502, a sole 1506, and a crown 1508. Crown 1508 comprises an upper region 1511 and a lower region 1513. Upper region 1511 comprises a top rail 1515. Golf club head 1500 further comprises a cavity 1530 located below top rail 1515 and above lower region 1513 of crown 1508.

Figure 16:
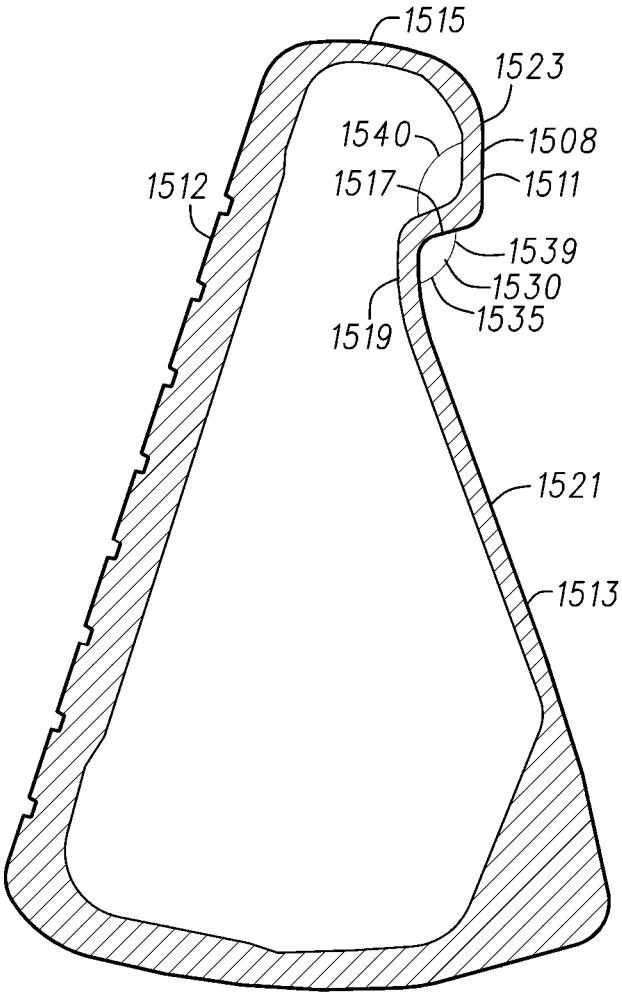
FIG. 16 depicts a cross-sectional view of the golf club head of FIG. 15 along the cross-sectional line XVI-XVI of FIG. 15.

FIG. 16 illustrates a cross-section of golf club head 1500 along the cross-sectional line XVI-XVI in FIG. 15, according to one embodiment. In some embodiments, cavity 1530 can be defined at least in part by upper region 1511 and lower region 1513. In many embodiments, cavity 1530 comprises a top wall 1517, a back wall 1519, a bottom incline 1521, a back cavity angle 1535 measured between top wall 1517 and back wall 1519, and at least one channel 1539. In some embodiments, an apex of top wall 1517 is approximately 0.25 inch to approximately 1.25 inches below an apex of top rail 1515. In some embodiments, the apex of top wall 1517 is approximately 0.375 inch below the apex of top rail 1515. In some embodiments, bottom incline 1521 can be at least approximately 0.50 inch to approximately 2 inches below an apex of top rail 1515. In many embodiments, back cavity angle 1535 can be approximately 70 degrees to approximately 110 degrees. In some embodiments, back cavity angle 1535 can be approximately 90 degrees.

In many embodiments, upper region 1511 comprises the top and back walls of the cavity; and the lower region of the crown comprises the bottom incline of the cavity. In some embodiments, upper region 1511 further comprises a rear wall 1523 adjacent to top wall 1517 of cavity 1530 and a rear angle 1540 measured between top wall 1517 of cavity 1530 and rear wall 1523 of upper region 1511. In many embodiments, rear angle 1540 is approximately 70 degrees to approximately 110 degrees.

In another embodiment, the golf club head can comprise a hosel. The hosel can comprise a hosel notch. The hosel notch can allow for iron-like range of loft and lie angle adjustability. Although not illustrated in FIG. 16, golf club head 1500 also can have a cascading sole or an internal radius transition at the sole.

The golf club heads with energy storage characteristics discussed herein may be implemented in a variety of embodiments, and the foregoing discussion of these embodiments does not necessarily represent a complete description of all possible embodiments. Rather, the detailed description of the drawings, and the drawings themselves, disclose at least one preferred embodiment of golf club heads with energy storage characteristics, and may disclose alternative embodiments of golf club heads with tiered internal thin sections.

Clause 1: A golf club head comprising: a hollow body; a strikeface; a heel region; a toe region opposite the heel region; a sole; a crown; and a cavity located behind the strikeface and on the sole of the club head, the cavity comprising: a front edge adjacent to the sole; a rear edge adjacent to the sole; a main portion extending inward from the sole between the front edge and the rear edge; an inset portion extending from the main portion toward the strikeface; an apex axis positioned along the deepest portion of the cavity and extending from the heel region to the toe region, the apex axis separating a front surface from a rear surface of the cavity, wherein: the front surface extends from the front edge to the apex axis; the rear surface extends from the apex axis to the rear edge; and at least a portion of the front surface extends toward the strikeface.

Clause 2: The golf club head of clause 1, wherein the volume of the club head is less than 60 cc.

Clause 3: The golf club head of clause 1, wherein the volume of the club head is between 40-60 cc.

Clause 4: The golf club head of clause 1, wherein the front edge of the cavity is offset from the strikeface by a distance less than or equal to 0.50 inch.

Clause 5: The golf club head of clause 1, wherein the front edge of the cavity is offset from the strikeface by a distance less than or equal to 0.10 inch.

Clause 6: The golf club head of clause 1, wherein the front edge of the cavity is offset from the strikeface by a constant distance.

Clause 7: The golf club head of clause 1, wherein the front edge of the cavity near a center of the strikeface is closer to the strikeface than the front edge of the cavity near at least one of the heel region and the toe region.

Clause 8: The golf club head of clause 1, wherein the front surface of the cavity further includes a forward most point positioned nearest the strikeface when taken in a side cross-sectional view of the club head, a rearward most point positioned farthest from the strikeface when taken in the side cross-sectional view of the club head, wherein an axis extending through the forward most point and the rearward most point intersects the strikeface at an acute angle.

Clause 9: The golf club head of clause 1, wherein the axis extending through the forward most point and the rearward most point of the front surface is positioned at an angle to a loft plane of the club head between 5 and 85 degrees.

Clause 10: The golf club head of claim 1, wherein the cavity further comprises a length extending from the heel portion to the toe portion; a loft plane of the club head is positioned through a geometric center of the strikeface; a plane, formed by a plurality of axes extending parallel to the loft plane and through the front edge of the cavity at each location along the length of the cavity, separates the main portion and the inset portion of the cavity.

Clause 11: A golf club head comprising: a hollow body; a strikeface; a heel region; a toe region opposite the heel region;

a sole; a crown; and a cavity located behind the strikeface and on the crown of the club head, the cavity comprising: a front edge adjacent to the crown; a rear edge adjacent to the crown; a main portion extending inward from the crown between the front edge and the rear edge; an inset portion extending from the main portion toward the strikeface; a nadir axis positioned along the deepest portion of the cavity and extending from the heel region to the toe region, the nadir axis separating a front surface from a rear surface of the cavity, wherein: the front surface extends from the front edge to the nadir axis; the rear surface extends from the nadir axis to the rear edge; and at least a portion of the front surface extends toward the strikeface.

Clause 12: The golf club head of clause 11, wherein the volume of the club head is less than 60 cc.

Clause 13: The golf club head of clause 11, wherein the volume of the club head is between 40-60 cc.

Clause 14: The golf club head of clause 11, wherein the front edge of the cavity is offset from the strikeface by a distance less than or equal to 0.50 inch.

Clause 15: The golf club head of clause 11, wherein the front edge of the cavity is offset from the strikeface by a distance less than or equal to 0.10 inch.

Clause 16: The golf club head of clause 11, wherein the front edge of the cavity is offset from the strikeface by a constant distance.

Clause 17: The golf club head of clause 11, wherein the front edge of the cavity near a center of the strikeface is closer to the strikeface than the front edge of the cavity near at least one of the heel region and the toe region.

Clause 18: The golf club head of clause 11, wherein the front surface of the cavity further includes: a forward most point positioned nearest the strikeface when taken in a side cross-sectional view of the club head; a rearward most point positioned farthest from the strikeface when taken in the side cross-sectional view of the club head; wherein an axis extending through the forward most point and the rearward most point intersects the strikeface at an acute angle.

Clause 19: The golf club head of clause 11, wherein the axis extending through the forward most point and the rearward most point of the front surface is positioned at an angle to a loft plane of the club head between 5 and 85 degrees.

Clause 20: The golf club head of clause 11, wherein: the cavity further comprises a length extending from the heel portion to the toe portion; a loft plane of the club head is positioned through a geometric center of the strikeface; a plane, formed by a plurality of axes extending parallel to the loft plane and through the front edge of the cavity at each location along the length of the cavity, separates the main portion and the inset portion of the cavity.

Replacement of one or more claimed elements constitutes reconstruction and not repair. Additionally, benefits, other advantages, and solutions to problems have been described with regard to specific embodiments. The benefits, advantages, solutions to problems, and any element or elements that may cause any benefit, advantage, or solution to occur or become more pronounced, however, are not to be construed as critical, required, or essential features or elements of any or all of the claims, unless such benefits, advantages, solutions, or elements are expressly stated in such claims.

As the rules to golf may change from time to time (e.g., new regulations may be adopted or old rules may be eliminated or modified by golf standard organizations and/or governing bodies such as the United States Golf Association (USGA), the Royal and Ancient Golf Club of St. Andrews (R&A), etc.), golf equipment related to the apparatus, methods, and articles of manufacture described herein may be conforming or non-conforming to the rules of golf at any particular time. Accordingly, golf equipment related to the apparatus, methods, and articles of manufacture described herein may be advertised, offered for sale, and/or sold as conforming or non-conforming golf equipment. The apparatus, methods, and articles of manufacture described herein are not limited in this regard.

While the above examples may be described in connection with a driver-type golf club, the apparatus, methods, and articles of manufacture described herein may be applicable to other types of golf club such as a fairway wood-type golf club, a hybrid-type golf club, an iron-type golf club, a wedge-type golf club, or a putter-type golf club. Alternatively, the apparatus, methods, and articles of manufacture described herein may be applicable to other type of sports equipment such as a hockey stick, a tennis racket, a fishing pole, a ski pole, etc.

Moreover, embodiments and limitations disclosed herein are not dedicated to the public under the doctrine of dedication if the embodiments and/or limitations: (1) are not expressly claimed in the claims; and (2) are or are potentially equivalents of express elements and/or limitations in the claims under the doctrine of equivalents.

What is claimed is:

1. A golf club head comprising:

a hollow body formed between a sole and a crown;

a front end comprising a strikeface extending between the sole and the crown and being operative to impact a golf ball;

a rear end;

a heel region;

a toe region opposite the heel region; and wherein a ground reference plane is defined such that the ground reference plane is tangential to and in contact with at least a portion of the sole, and a front reference plane is defined such that the front reference plane is perpendicular to the ground reference plane and both tangential to and in contact with a forward most point of the strikeface; and wherein a loft plane is defined such that the loft plane is tangential to and in contact with a geometric center of the strikeface;

wherein the sole and strikeface comprise the same material;

wherein the sole defines a cavity on an outer surface of the sole and behind the strikeface, the cavity comprising:

a front edge coincident with an outer profile of the sole;

a front surface extending inward from the front edge;

a rear edge coincident with the outer profile of the sole;

a rear surface extending inward and forward from the rear edge;

a cavity length measured in a toe to heel direction;

wherein the cavity further comprises a main portion and an inset portion;

wherein the main portion extends inward from the outer profile of the sole between the front edge and the rear edge;

wherein the inset portion extends from the main portion toward the strikeface;

wherein a plurality of axes are defined extending parallel to the loft plane and through the front edge at each of a plurality of locations along the cavity length;

wherein the inset portion is separated from the main portion by a first plane defined by the plurality of axes;

wherein a reference line is perpendicular to the loft plane and extends through the front edge; and wherein within a cross-sectional plane defined by the reference line, a depth of the cavity, measured parallel to the loft plane and from the rear surface to the reference line, is the greatest at an apex;

wherein an apex axis defines a maximum depth of the cavity at any location along the length of the cavity;

the front surface further comprises a side wall extending into the cavity from the front edge, and an inner wall extending into the cavity from the rear surface that extends forward from the rear edge;

the inset portion is positioned at a first angle to the side wall and a second angle to the inner wall;

the first angle ranges from 85 to 95 degrees;

the second angle ranges from 85 to 95 degrees;

wherein the cavity comprises the same material as the sole such that the strikeface, sole, and cavity comprise the same material.

2. The golf club head of claim 1 wherein the cavity comprises an inner surface, an outer surface, and a thickness measured as the minimum distance between the outer surface and the inner surface.

3. The golf club head of claim 2 wherein the thickness is substantially constant from near the front edge to near the rear edge.

4. The golf club head of claim 2, wherein the thickness varies from near the front edge to near the rear edge.

5. The golf club head of claim 1, wherein the cavity is offset from the loft plane by a constant distance extending from near the heel region to near the toe region.

6. The golf club head of claim 1, wherein the cavity is offset from the loft plane by a varying distance.

7. The golf club head of claim 6, wherein the front edge of the cavity near the geometric center of the strikeface is positioned closer to the strikeface than the front edge of the cavity near the heel region.

8. The golf club head of claim 6, wherein the front edge of the cavity near the geometric center of the strikeface is positioned closer to the strikeface than the front edge of the cavity near the toe region.

9. The golf club head of claim 1, wherein the front edge of the cavity is offset from the strikeface by a distance less than or equal to 0.50 inch (1.27 cm).

10. The golf club head of claim 1, wherein the front edge of the cavity is offset from the strikeface by a distance less than or equal to 0.10 inch (0.254 cm).

11. The golf club head of claim 1, wherein the front surface further comprises a forward most point and a rearward most point in any front-to-rear cross-section of the golf club head;

wherein the forward most point is positioned along the front surface nearest the front reference plane or strikeface a first distance D1, and the rearward most point is positioned along the front surface farthest from the front reference plane or strikeface a second distance D2.

12. The golf club head of claim 11, wherein the second distance D2 is greater than the first distance D1 in at least one front-to-rear cross-section of the cavity.

13. The golf club head of claim 11, wherein the first distance D1 and the second distance D2 are constant.

14. The golf club head of claim 11, wherein the first distance D1 and the second distance D2 vary from the heel region to the toe region of the golf club head.

15. The golf club head of claim 11, wherein an axis extends through the forward most point and the rearward most point;

wherein the axis intersects the strikeface at an acute angle.

16. The golf club head of claim 15, wherein the acute angle ranges from 0 to 90 degrees.

* * * * *